US012529198B2

(12) United States Patent
Romeijn et al.

(10) Patent No.: US 12,529,198 B2
(45) Date of Patent: Jan. 20, 2026

(54) RECIRCULATING CYLINDRICAL ROLLERS ASSEMBLY FOR SUPPORTING AN OBJECT ON A RAIL, E.G. IN A PILE HOLDING SYSTEM

(71) Applicant: ITREC B.V., Schiedam (NL)

(72) Inventors: Eric Romeijn, Schiedam (NL); Hendrikus Jacobus Weterings, Schiedam (NL)

(73) Assignee: ITREC B.V., Schiedam (NL)

( * ) Notice: Subject to any disclaimer, the term of this patent is extended or adjusted under 35 U.S.C. 154(b) by 241 days.

(21) Appl. No.: 18/037,734

(22) PCT Filed: Dec. 15, 2021

(86) PCT No.: PCT/EP2021/086024
§ 371 (c)(1),
(2) Date: May 18, 2023

(87) PCT Pub. No.: WO2022/129246
PCT Pub. Date: Jun. 23, 2022

(65) Prior Publication Data

US 2024/0093454 A1 Mar. 21, 2024

(30) Foreign Application Priority Data

Dec. 17, 2020 (NL) ..... 2027149
Aug. 4, 2021 (NL) ..... 2028920

(51) Int. Cl.
*E02D 7/16* (2006.01)
*E02D 13/04* (2006.01)

(52) U.S. Cl.
CPC ..... *E02D 7/16* (2013.01); *E02D 13/04* (2013.01)

(58) Field of Classification Search
CPC ..... E02D 7/16; E02D 13/04; E02D 7/14
See application file for complete search history.

(56) References Cited

U.S. PATENT DOCUMENTS 11,293,158 B2 * 4/2022 Roodenburg ..... E02D 27/425
11,313,096 B2 * 4/2022 Roodenburg ..... E02D 27/52
(Continued)

FOREIGN PATENT DOCUMENTS

CN 110106880 A * 8/2019 ..... E02D 13/04
CN 110325776 A * 10/2019 ..... E02D 13/04
(Continued)

OTHER PUBLICATIONS

International Search Report for PCT/EP2021/086024 (PCT/ISA/210) mailed on May 3, 2022.
(Continued)

*Primary Examiner* — Frederick L Lagman
(74) *Attorney, Agent, or Firm* — Birch, Stewart, Kolasch & Birch, LLP

(57) ABSTRACT

An assembly for supporting an object on a rail comprises a load bearing housing and an endless chain of steel cylindrical rollers arranged for recirculating along a closed path. The assembly comprises an elastically compressible resilient insert which is sandwiched between a steel central body and a steel raceway member above a work portion of the path, so that the central body is resiliently supported on an operative set of the cylindrical rollers via the insert and the steel raceway member.

35 Claims, 13 Drawing Sheets

(56) References Cited

U.S. PATENT DOCUMENTS

| | | | | |
|---|---|---|---|---|
| 11,795,650 | B2 * | 10/2023 | Roodenburg | E02D 7/02 |
| 2024/0208779 | A1 * | 6/2024 | Wijning | E02B 17/00 |

FOREIGN PATENT DOCUMENTS

| | | | | | |
|---|---|---|---|---|---|
| CN | 111439683 | A | * | 7/2020 | B66C 1/42 |
| CN | 111655934 | A | * | 9/2020 | B63B 35/00 |
| CN | 112088234 | A | * | 12/2020 | B63B 35/00 |
| CN | 115772894 | A | * | 3/2023 | B63B 35/03 |
| JP | 9-25630 | A | | 1/1997 | |
| WO | WO 01/57355 | A1 | | 8/2001 | |
| WO | WO 2019/125172 | A2 | | 6/2019 | |
| WO | WO 2019/125172 | A3 | | 6/2019 | |
| WO | WO 2019/172752 | A2 | | 9/2019 | |
| WO | WO 2019/172752 | A3 | | 9/2019 | |

OTHER PUBLICATIONS

Written Opinion of the International Searching Authority for PCT/EP2021/086024 (PCT/ISA/237) mailed on May 3, 2022.

* cited by examiner

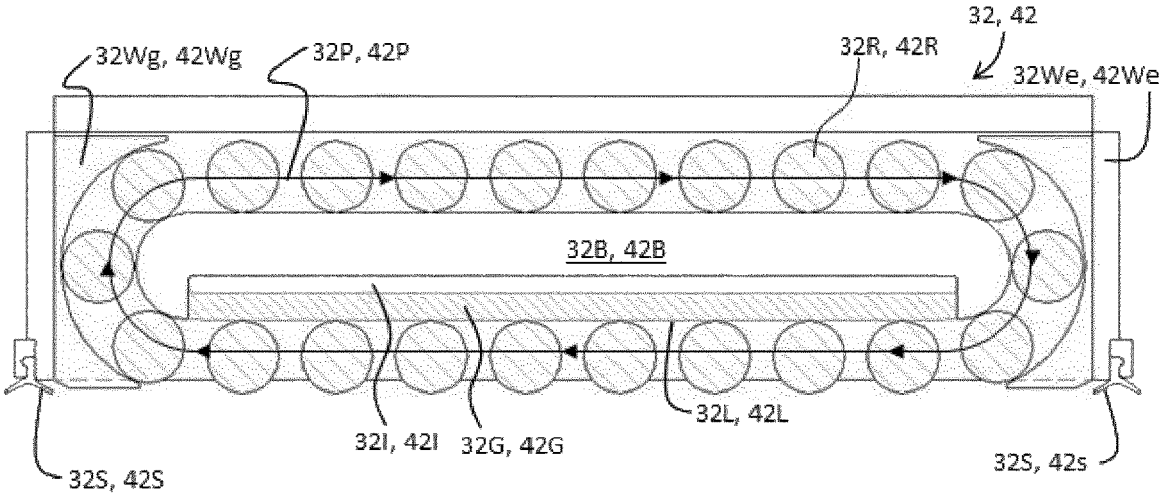
▲Fig. 3a ▼ Fig. 3b
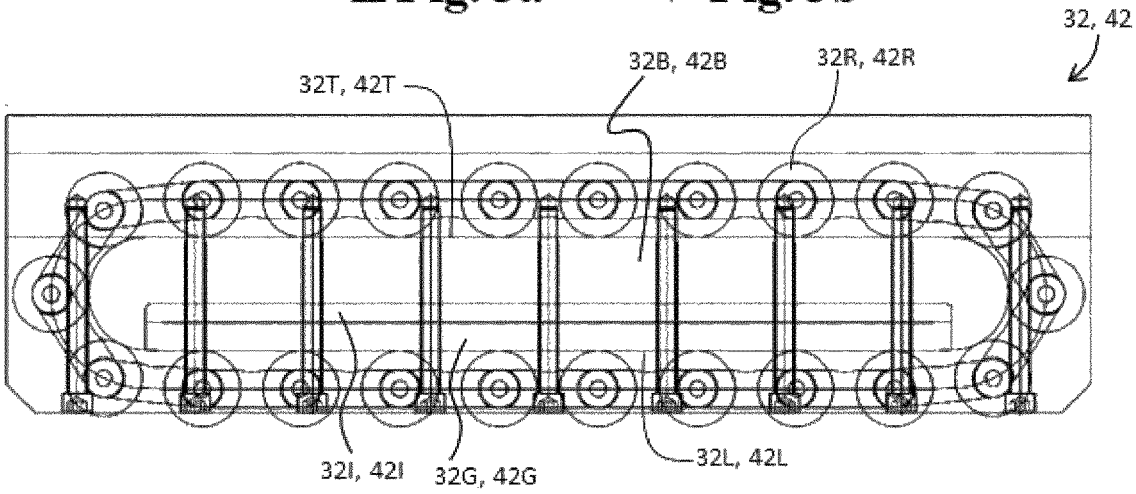
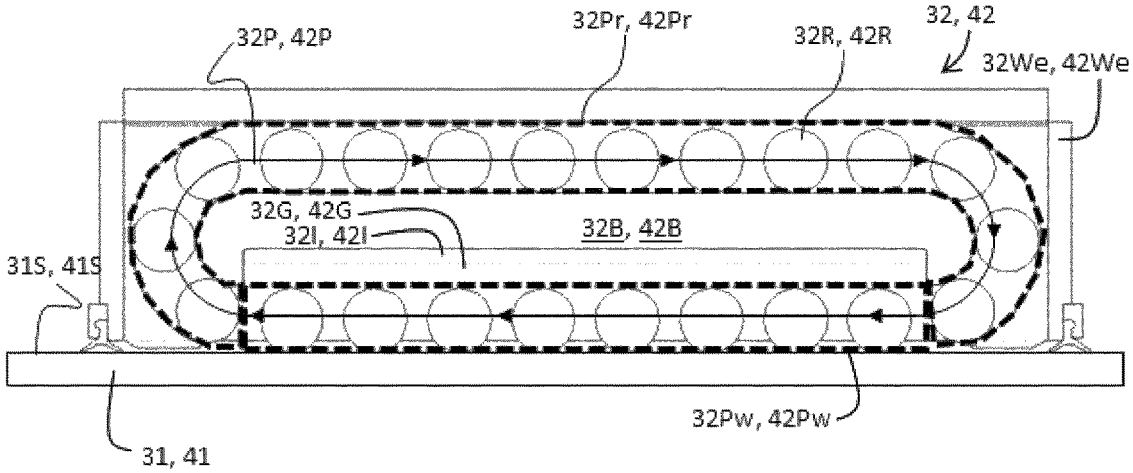
Fig. 4

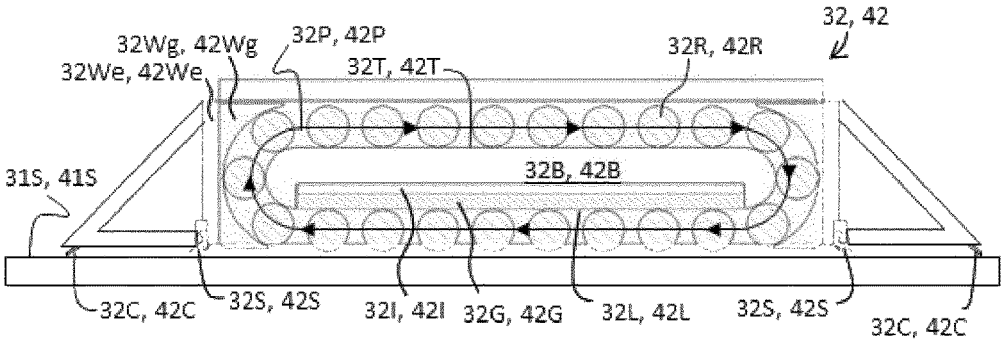
Fig. 9
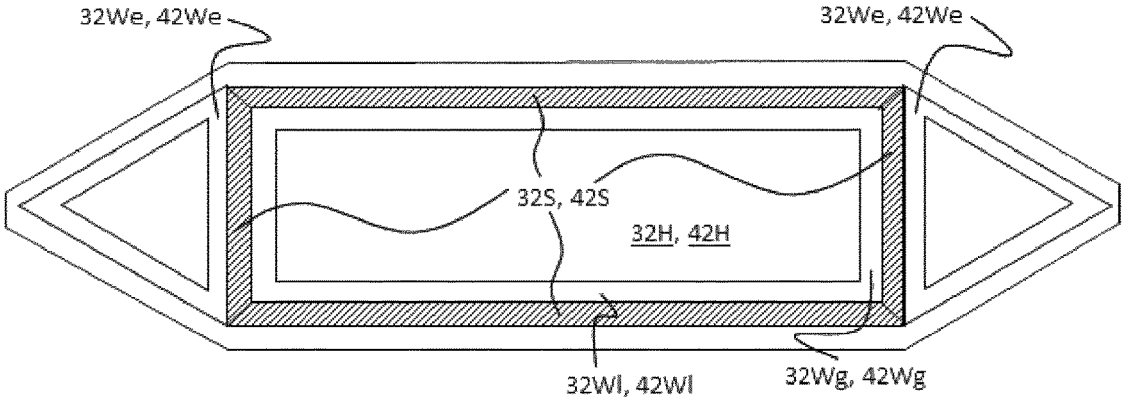
Fig. 10 ▲
Fig. 11 ▶
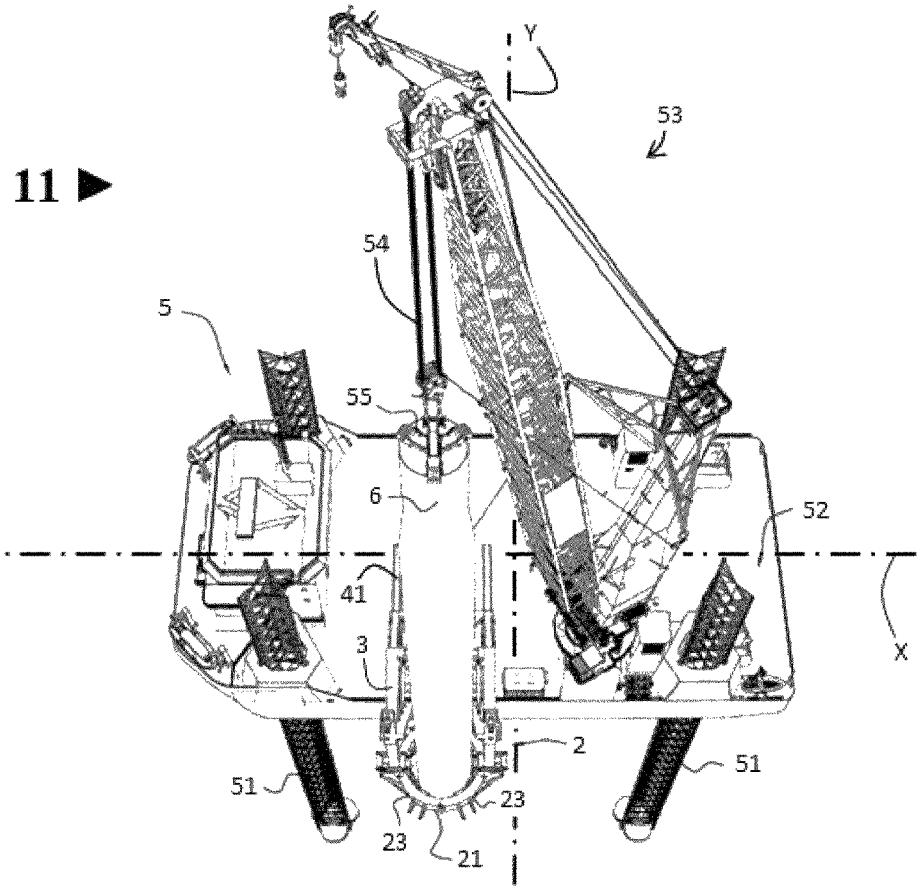

RECIRCULATING CYLINDRICAL ROLLERS ASSEMBLY FOR SUPPORTING AN OBJECT ON A RAIL, E.G. IN A PILE HOLDING SYSTEM

FIELD OF THE INVENTION

The present invention according to a first aspect pertains to an assembly for supporting an object on a rail, e.g. a pile holder that is configured for holding a pile, e.g. a monopile forming a foundation for supporting an offshore wind turbine, to be driven into the seabed.

For example, WO2019125172 discloses an X-Y motion supported pile holder having rails extending in the X-direction and rails extending in the Y-direction. The pile holder is supported on these rails by wheels. As the load on the wheels is very large, these wheels are commonly designed with a large diameter in view of stress distribution and friction.

In the case of a pile holder, the load supported on the rails increases in particular because there is a trend towards larger piles to be held by the pile holder as there is a trend towards larger offshore wind turbines. Hence, it is expected that in the near future piles need to be installed that are longer than 100 metres, possibly 120 metres or more. The weight of such piles may be more than 1000 mt, possibly 1300 mt or even more.

OBJECT OF THE INVENTION

The first aspect of the present invention aims to provide an improved assembly for supporting an object on a rail, e.g. in view of ever increasing requirements, e.g. in the field of pile holding for installation of a foundation pile for an offshore wind turbine.

SUMMARY OF THE INVENTION

The first aspect of the invention provides an assembly for supporting an object on a rail whilst the object moves along the rail. This assembly comprises a load bearing housing for carrying the object. The assembly further comprises an endless chain of steel cylindrical rollers, which are arranged for recirculating along a closed path around a steel raceway member and a steel central body of the assembly which central body is attached to or integral with the load bearing housing. The path includes

- a work portion defined by a flat load bearing surface of the steel raceway member of the assembly, in which work portion an operative set of the cylindrical rollers engages the rail, and
- a return portion defined by a return surface of the steel central body of the assembly in which a remaining set of the cylindrical rollers is free from the rail.

The assembly further comprises an elastically compressible resilient insert, which resilient insert is sandwiched between the steel central body and the steel raceway member above the work portion, so that the central body is resiliently supported on the operative set of the cylindrical rollers via the insert and the steel raceway member.

When the inventive assembly is used in conjunction with the X-Y motion support of a pile holder, as in preferred embodiments of the first aspect of the invention, an advantage is that the effective height of the X-Y motion support for the pile holder can be reduced as no longer use is made of large diameter wheels for this purpose. This improves stability of the support of the load on the vessel and of the vessel including the load, e.g. so that control of the positioning thereof becomes easier. Furthermore, the rails are no longer subject to unfavourable localized mechanical loading at the relatively small interface between a wheels and the rail. This may allow to reduce the requirements on the mechanical properties of the rails. Also, compared to the known arrangement of large diameter wheels, the inventive assembly may provide a smooth movement of the load along the rails. For example, stick-slip effects may be reduced to the benefit of control of accurate dynamic positioning of the pile holder, which becomes increasingly more challenging as the weight to be handled (e.g. of the pile) is larger.

The rail may be mounted or mountable to a surface, e.g. on top thereof, e.g. on a vessel, e.g. to a deck thereof, whilst the object is able to move along the rail. The rail may be mounted to the surface via another such rail, as is for example the case in an embodiment of a construction according to the first aspect of the invention which will be discussed later. The rail may alternatively be mounted or mountable to extend sideways, or be suspended to support the object from above. The term 'on' is to be interpreted to include such configurations.

The assembly comprises a load bearing housing for carrying the object on the assembly, e.g. for mounting the object to the assembly. By carrying the object, and engaging with the rail, the assembly supports the object on the rail. In embodiments, the assembly is suitable for supporting the object on multiple rails, for example two parallel rails.

The assembly comprises an endless chain of steel cylindrical rollers, which are arranged for recirculating along a closed path defined by the assembly. For example, between 20 and 25 cylindrical rollers are arranged in the endless chain. The chain is formed by a row of the steel cylindrical rollers, the rotation axes thereof being parallel to each other, as is known in the art.

For example, the cylindrical rollers may be physically interconnected, or push each other forward via intermediate elements between adjacent rollers.

The closed path runs around a steel raceway member and a steel central body. Thus the steel raceway member and the steel central body form an inner circumference of the closed path. The path includes a work portion and a return portion. The work portion is defined by a load bearing surface of the raceway member of the assembly, in which work portion an operative set of the cylindrical rollers engages the rail. Thereby, the work portion supports the load of the object on the rail. The load bearing surface is generally smooth, and the raceway member having this surface is non-resilient, as it is made of steel. The cylindrical rollers also being made of steel, makes that friction between the cylindrical rollers and the load bearing surface is minimized. In the return portion, defined by a return surface of the steel central body, a remaining set of the cylindrical rollers is free from the rail. Thus, no cylindrical rollers of the remaining set engage the rail, and thus support the object on the rail. This may be achieved by having the return surface run, at a front and rear side of the load bearing surface, directly upwards from the load bearing surface. In an example the return portion has a section which is parallel to the work portion.

In operation, that is, when the object and the assembly moves in a longitudinal direction of the rail, the operative set of the cylindrical rollers moves along the work portion of the closed path in the opposite direction of this movement direction. In doing so, the cylindrical rollers roll over the rail and over the load bearing surface. In the return portion of the closed path, the cylindrical rollers move from the side of the work portion where the cylindrical rollers exit the work portion, along the return portion to the side of the work portion where the cylindrical rollers enter the work portion. In doing so, the cylindrical rollers roll over the return surface.

A practical shape of the closed path has a work portion that runs longitudinally along a plurality of cylindrical rollers, for example 6-10 cylindrical rollers, and runs along a top surface of the rail when the assembly engages with the rail, and has a straight part of the return portion, e.g. of equal length, that is above and parallel to the work portion. The straight part of the return portion and the work portion may be interconnected by semi-circular front and back portions of the closed path. Or, for example, the closed path is in the shape of a rounded rectangle with the long sides being formed by the work portion and the straight part of the return portion.

The engagement of the rails by the assembly may be only from above, however it is preferred that the assembly limits also the movement of the assembly with respect to the rail in the lateral direction of the rail. In an embodiment, the cylindrical rollers may be slightly concave. The lateral movement relative to the rail may for example also be limited by providing one or more elements, e.g. rollers or wheels with a vertical rotation axis, which engage the rail laterally. These may be mounted to or integral with the assembly.

The cylindrical rollers may have a hardened surface to further reduce friction at the interfaces thereof with the rail and the load bearing surface.

According to the first aspect of the invention, the assembly comprises an elastically compressible resilient insert between the steel central body and the steel raceway. The central body is resiliently supported via the insert on the operative set of the cylindrical rollers.

The insert may, for example, be an elastically compressible resilient plate, on top of which the load bearing body is attached.

The central body is, preferably, attached to the resilient insert directly on top thereof.

A second aspect of the invention relates to a pile holding system configured to be mounted on a vessel, e.g. for installation of a pile adapted to support an offshore wind turbine, e.g. a monopile, The pile holding system according to the second aspect of the invention comprises:

- a support assembly configured to be mounted on the vessel, e.g. on a deck of the vessel,
- a pile holder mounted on the support assembly, wherein the pile holder is configured to hold a pile in a vertical orientation, wherein the pile holder comprises at least one ring, which is provided with multiple pile engaging devices distributed about a circumference of the ring, each pile engaging device being adapted to engage an exterior of a pile extending through the ring, e.g. each pile engaging device comprises one or more pile guiding rollers, wherein the ring comprises a ring base that is secured to the support assembly and one or more pivotal jaws, e.g. two semi-circular jaws, each jaw being pivotally mounted at an inner end thereof to the ring base and having an outer end, the one or more jaws being movable between a closed position, wherein the respective ring forms a closed annulus, and an opened position, wherein an opening is present allowing for introduction of the pile into the pile holder.

Typically, pile holding systems are mounted on vessels for supporting and guiding a pile adjacent the vessel while the pile is lowered towards and/or is driven into the sea floor. A crane is used for upending the pile, i.e. tilting the pile from a horizontal transport position into a vertical position for being driven into the sea floor, and for introducing the pile into the ring of the pile holding system. The pile is introduced into the ring by slewing movement of the crane and/or by tilting movement of the boom of the crane.

For example, WO2019125172 discloses a pile holding system comprising a pile holder mounted on a support assembly, the support assembly being configured to be mounted on a deck of a vessel. The pile holder comprises a ring, which ring is provided with multiple pile engaging devices distributed about a circumference of the ring. Furthermore, the ring comprises a ring base, that is secured to the support assembly, and two semi-circular jaws, each jaw being pivotally mounted at an inner end thereof to the ring base. The jaws are movable between a closed position, wherein the respective ring forms a closed annulus, and an opened position, wherein an opening is present allowing for introduction of the pile into the pile holder.

An object of the second aspect of the invention is to provide a pile holding system that allows for a versatile use of the pile holding system.

According to the second aspect, the invention provides a pile holding system wherein the ring base of the ring and the support assembly are provided with cooperating releasable securing members that are configured to provide multiple distinct mounting angle positions, seen in plan view, of the ring relative to the support assembly.

Thus, with a pile holding system according to the second aspect of the invention, the ring can be mounted at multiple distinct mounting angle positions relative to the support assembly. This allows for a more versatile use of the pile holding system.

For example, the ring can be mounted in a mounting angle position for introducing piles upended at the left side of the pile holding system and in an alternative mounting angle position for introducing piles upended at the right side of the pile holding system. Thus, the allows for optimal use of the pile holding system independent of piles being upended at the left or at the right of the pile holding system.

A third aspect of the invention relates to a method for installation of a pile of an offshore wind turbine, wherein use is made of:

- a vessel having a hull with a deck and a side, e.g. a jack-up vessel,
- a crane erected on the deck of the vessel and having a boom that is slewable by a slew drive of the crane about a vertical slew axis and that is luffable about a boom axis by a luffing mechanism of the crane, which crane is configured to hoist and suspend the pile,
- an upending tool mounted on said deck of the vessel within reach of the crane,
- a pile holding system, distinct from said upending tool, mounted on said deck of the vessel within reach of the crane, the pile holding system comprising:
  - a support assembly configured to be mounted on the vessel, e.g. on a deck of the vessel,
  - a pile holder mounted on the support assembly, wherein the pile holder is configured to hold a pile in a vertical orientation, wherein the pile holder comprises at least one ring, which is provided with multiple pile engaging devices distributed about a circumference of the ring, each pile engaging device being adapted to engage an exterior of a pile extending through the ring, e.g. each pile engaging device comprises one or more pile guiding rollers, wherein the ring comprises a ring base that is secured to the support assembly and one or more pivotal jaws, e.g. two semi-circular jaws, each jaw being pivotally mounted at an inner end thereof to the ring base and having an outer end, the one or more jaws being movable between a closed position, wherein the respective ring forms a closed annulus, and an opened position, wherein an opening is present allowing for introduction of the pile into the pile holder, wherein the method comprises:

upending of a pile using the upending tool to tiltable support a lower section of the pile and the crane to engage a lift an upper section of the pile, so that the pile is brought into vertical orientation at an upending position relative to the hull and suspended from the crane, arranging the ring of the pile holding system so that the vertically suspended pile is laterally introducible into the opened annulus of the ring, closing the one or more jaws of the ring, lowering the pile onto the seabed and driving the pile into the seabed whilst the pile holder holds the pile in vertical orientation, characterized in that for said laterally introduction of the pile into the opened annulus of the ring, the upending tool and the ring of the pile holding system are arranged such that transfer of the vertically suspended pile by means of the crane from the upending position into the opened annulus of the ring solely involves operation of the slew drive of the crane so that the pile, seen in plan view, passes along a curved trajectory having a radius about the slew axis of the crane.

The method according to the third aspect of the invention, i.e. the transfer of the vertically suspended pile solely by operation of the slew drive of the crane so that the pile, seen in plan view, passes along a curved trajectory having a radius about the slew axis of the crane, significantly reduces complexity of said transfer, e.g. avoiding need to luff the boom during said transfer.

The fourth aspect of the invention relates to a pile holding system configured to be mounted on a vessel, e.g. for installation of a pile adapted to support an offshore wind turbine, e.g. a monopile, the pile holding system comprising:

a support assembly configured to be mounted on the vessel, e.g. on a deck of the vessel, a pile holder mounted on the support assembly, wherein the pile holder is configured to hold a pile in a vertical orientation, wherein the pile holder comprises at least one ring, which is provided with multiple pile engaging devices distributed about a circumference of the ring, each pile engaging device being adapted to engage an exterior of a pile extending through the ring during installation of the pile into the seabed, e.g. each pile engaging device comprises one or more pile guiding rollers, wherein the ring comprises a ring base that is secured to the support assembly and one or more pivotal jaws, e.g. two semi-circular jaws, each jaw being pivotally mounted at an inner end thereof to the ring base and having an outer end, the one or more jaws being movable between a closed position, wherein the respective ring forms a closed annulus, and an opened position, wherein an opening is present allowing for Jateral introduction of a vertically suspended pile into the opened annulus of the ring, wherein the ring base is provided, in addition to one or more of said multiple pile engaging devices, with one or more distinct bumper devices that are configured to act as a bumper for the pile when being introduced laterally into the opened annulus of the ring, wherein the one or more bumper devices are each embodied with a mobile bumper member and an associated bumper actuator, each bumper device being configured to move the bumper member into an operative position that is inward of the one or more pile engaging devices on the ring base so that the pile stays clear of said one or more pile engaging devices during said lateral introduction and that each bumper device being configured to move the bumper member into a non-operative position that is outward of the one or more pile engaging devices on the ring base so that the pile is positionable by means of the pile engaging devices. In an embodiment, each mobile bumper member comprises a bumper beam that is at one end pivotally secured to the ring base about a vertical axis, and wherein the actuator is configured to pivot the bumper beam relative to the ring base.

A fifth aspect of the invention relates to a pile holding system, configured to be mounted on a vessel, e.g. for installation of a pile adapted to support an offshore wind turbine, e.g. a monopile, the pile holding system comprising a:

a support assembly configured to be mounted on the vessel, e.g. on a deck of the vessel, a pile holder supported by the support assembly, wherein the pile holder is configured to hold a pile in a vertical orientation, wherein the pile holder comprises at least one ring, which ring is provided with multiple pile engaging devices distributed about a circumference of the ring, each pile engaging device being adapted to engage an exterior of a pile extending through the ring, e.g. each pile engaging device comprises one or more pile guiding rollers, wherein the ring comprises a ring base and one or more pivotal jaws, e.g. two semi-circular jaws, each jaw being pivotally mounted at an inner end thereof to the ring base and having an outer end, the one or more jaws being movable between a closed position, wherein the respective ring forms a closed annulus having a central axis, and an opened position, wherein an opening is present allowing for introduction of the pile into the pile holder, wherein the ring base is movably supported by the support assembly, such that the ring can rotate about the central axis relative to the support assembly, to thus adjust the position the opening of the ring relative to the support assembly.

With a pile holding system according to the fifth aspect, the position of the ring can be adjusted while the ring remains mounted to the support assembly. This in contrast with a pile holding system according to the second aspect of the invention, wherein adjusting the position of the ring requires the ring to be disconnected from the support assembly, and thus does not allow for reportioning the ring while a pile is received in the ring.

The pile holding assembly according to the fifth aspect of the invention provides the same benefits as the pile holding system according to the second aspect of the invention, and can advantageously be used with a method according to the third aspect of the invention.

In an embodiment according to the first aspect of the invention, the central body has a recess which corresponds to the dimensions of the combination of the resilient insert and the raceway member, so that the resilient insert is flush with a bottom surface of the central body.

In an embodiment according to the first aspect of the invention, the elastically compressible resilient insert is made of a composite material, e.g. that is adapted for use in bearings, such as a fibre-reinforced plastic material. For example, a thermoset composite bearing material incorporating technical fabrics impregnated with thermosetting resins and optionally further additives. For example, containing one or more of polyester fibers, aramid fibers, polyester resin, epoxy resin, PTFE, molybdenum disulfide, graphite, calcium carbonate. A particularly suitable material for the insert is presently known under the registered trade mark Orkot®.

The elastically compressible resilient insert provides for a forgiving support of the central body, and thereby, of the object supported by the assembly, on the operative set of the cylindrical rollers. By the resilient support of the object on the operative set of the cylindrical rollers, the load of the object exerted on the central body is distributed over the cylindrical rollers, to the benefit of a favourable mechanical loading of the cylindrical rollers and the rail. By the insert, the insert thus absorbs local discontinuities in the load profile along the work portion, e.g. edge loading, misalignment, including discontinuities at the interface of the cylindrical rollers and the rail and/or of the cylindrical rollers and the raceway surface, such as dents, bumps, or small slants in these surfaces.

The raceway member forms the load bearing surface and guides the operative set of the cylindrical rollers between the load bearing surface and a surface of the rail. The raceway member is disposed between the resilient insert and the operative set of the cylindrical rollers, and defines, at the side of the operative set of the cylindrical rollers, the work portion of the path. Via the raceway member, e.g. raceway plate, the central body is thus supported on the operative set of rollers. The load bearing surface engages the cylindrical rollers, and guides them as these move along the work portion of the path.

The resilient insert engages the raceway member, e.g. is attached thereto at their interface, e.g. directly on top thereof. To be able to benefit from the effects of the insert, the movement of the raceway member relative to the central body is preferably not limited, e.g. by directly fixedly interconnecting the raceway member to the central body.

Preferably, the resilient insert is embodied as a plate. Preferably, the raceway member is embodied as a plate. Most preferably, the resilient insert and raceway member are both plates, preferably of equal width and length, and preferably stacked on top of each other so that their sides axially coincide. Preferably, the resilient insert, alike the raceway member, longitudinally covers only the work portion.

The central body, preferably, engages, or is preferably attached to, the resilient insert directly on top thereof.

In an embodiment according to the first aspect of the invention, the central body has a recess e.g. which corresponds to the dimensions of the attached resilient insert and raceway member, with the resilient insert and raceway member being disposed in the recess so that these are axially enclosed thereby. Preferably, this is done so that the load bearing surface of the raceway member is flush with the return surface of the central body, and the central body and the inner circumference of the closed path as formed by the load bearing and return surface runs fluently and continuously.

Alike the load bearing surface, the return surface of the central body is smooth, and the central body is non-resilient as it is made of steel, so that any friction between the cylindrical rollers rolling over the return surface is reduced to a minimum.

In an embodiment, the raceway member and the resilient insert are both in the form of a plate, and the raceway member has a smaller thickness than, e.g. corresponding to around 55-65% of, a thickness of the raceway member.

In an embodiment according to the first aspect of the invention, the assembly further comprises a second endless chain of recirculating cylindrical rollers, arranged for recirculating along a second closed path of which a work portion and a return portion are defined by respectively a second flat load bearing surface of a second steel raceway member of the assembly and a second return surface of the central body. The two closed paths of the assembly are laterally juxtaposed and parallel to one another, so that the cylindrical rollers, in operation, move in the same direction. In the work portion, an operative set of the cylindrical rollers of the second endless chain engages the rail, and in the return portion a returning portion of these cylindrical rollers is free from the rail. In this embodiment, the central body thus has two return surfaces defining the respective return portions, and is resiliently supported on the cylindrical rollers of both endless chains via respective raceway members and respective resilient inserts, or alternatively one integral resilient insert for distributing the load over the two operative portions as well. Having one central body for the two endless chains, may provide advantages in terms of robustness, compactness and ease of manufacturing. In an alternative embodiment, instead of an integral central body for both endless chains, a separate second central body may be provided for the second endless chain, having the return surface thereof.

In an embodiment according to the first aspect of the invention, the assembly is provided, at least around the work portion of the recirculating cylindrical rollers, with one or more seals. These seals may extend between bottom surfaces of the assembly which enclose the work portion, and the upper surface of the rail. For example the seals extend between bottom surfaces of walls of the assembly, e.g. longitudinal wall parts and end walls which together enclose the work portion, which will be discussed later, and the upper surface of the rail. The seals define, e.g. together with the walls and wall parts, between the load bearing surface and the upper surface of the rail a grease chamber for the operative set of the recirculating cylindrical rollers. For example, the seals are in a cross-section thereof substantially V-shaped. The grease inside the grease chamber may further reduce the amount of friction between at least the load bearing surface and the cylindrical rollers, for example also between the return surface and the cylindrical rollers. The seals defining the grease chamber, are provided for keeping the grease inside the grease chamber and/or for preventing grease and/or dirt to enter the grease chamber from outside the grease chamber. Therefore these seals, preferably, abut the upper surface of the rail as tightly as possible, e.g. even during motion of the assembly along the rail, so that as less as possible of the grease escapes from the grease chamber or enters it between the rail and the seal. Preferably, this abutment is such as to not significantly increase the friction between the assembly and the rail upon movement thereover. For example, an inner seal is provided for keeping the grease inside the grease chamber, and an outer seal is provided for preventing grease and/or dirt to enter the grease chamber.

In an embodiment according to the first aspect of the invention, the housing is provided at a front and/or rear side, facing a longitudinal direction of the rail, and at a longitudinal distance from the work portion, with respectively a front and/or rear scraper engaging the upper surface of the rail for cleaning the rail, for example from any grease that has escaped from the grease chamber, when provided.

In an embodiment according to the first aspect of the invention, the housing comprises a front and rear vertical end wall which extend laterally respectively at the front and rear side of the assembly, and a front and rear guide wall which are attached to respectively the front and rear end wall and define respectively a front and rear section of the return portion of the closed path opposite the return surface. Preferably the attachment is via one or more elongate mounting elements, for example one or more bolts, screws or similar, which extend perpendicularly through the end walls and longitudinally stick into the guide walls. The seals may be provided to extend along these end walls, e.g. be attached thereto underneath the end walls.

In an embodiment wherein the assembly comprises two endless chains of cylindrical rollers, and thus two closed paths, as described before, the housing may comprise a second front guide wall and a second rear guide wall, which are attached to respectively the front and rear end wall and define respectively a front and rear section of the return portion of the second closed path opposite the second return surface. The fact that the guide walls associated with each of the endless chains are at either longitudinal side of the assembly attached to the same end wall, may advantageously improve the stability of the assembly and the distribution of the load forces over the assembly so as to favour the mechanical stress profile in the material of the housing.

In an embodiment according to the first aspect of the invention having a front and/or rear scraper, the housing of the assembly further comprises a front and/or rear frame which protrude respectively from the front and/or rear end wall in a frontward and/or rearward direction, wherein the front and/or rear scraper is mounted underneath the respective frame at a longitudinal end thereof.

The central body may in embodiments be attached to the housing. The central body may in other embodiments be integral with the housing. The treads for guiding the head ends of the roller axes and/or the longitudinal wall parts may be integral with the central body. Integrating the parts may provide advantages in terms of robustness and ease of manufacturing.

In an embodiment according to the first aspect of the invention the cylindrical rollers of the endless chain(s) each rotate around a respective roller axis of which head ends run over respective treads formed by vertical protrusions from the central body. These treads extend longitudinally along the closed path at respective lateral sides of the closed path.

In an embodiment according to the first aspect of the invention the assembly further comprises left upper and lower and right upper and lower longitudinal wall parts. These longitudinal wall parts form upper and lower vertical protrusions from the central body at the left and right ends thereof, and extend longitudinally over at a least length of the closed path.

Preferably, the left upper and lower are interconnected, and the right upper and lower longitudinal wall parts are interconnected, via one or more elongate mounting elements, e.g. one or more bolts, screws or similar, which vertically extend inside the respective upper and lower longitudinal wall parts and through the respective lateral end of the central body. Preferably, multiple elongate mounting elements are distributed longitudinally along the wall parts. This configuration with elongate mounting elements may benefit the distribution of the mechanical load over the wall parts and the central body, transferring the load through the mounting elements. Furthermore, the configuration provides stability and robustness to the assembly.

In an embodiment wherein there are two endless chains, and thus two closed paths, the assembly may further comprise intermediate upper and lower longitudinal wall parts, which form upper and lower vertical protrusions from the central body in between the two closed paths, and which extend longitudinally over at least a length of the closed path. Alike the left and right longitudinal wall parts, also the intermediate upper and lower longitudinal wall parts are preferably interconnected via one or more elongate mounting elements, e.g. one or more bolts, screws or similar, which vertically extend inside the respective upper and lower longitudinal wall parts and through a central part of the central body. Preferably, multiple elongate mounting elements are distributed longitudinally along the wall part.

In an embodiment according to the first aspect of the invention wherein the end walls are present, the longitudinal wall parts are preferably connected to the end walls via one or more elongate mounting elements which extend perpendicularly through the end walls and longitudinally stick into the longitudinal wall parts.

In an embodiment according to the first aspect of the invention, at a front and rear side of the load bearing surface, the return surface runs upwardly directly from the load bearing surface. This is to achieve that only the operative cylindrical rollers inside the work portion of the path are in contact with the rail, and thus support the load on the rail. Thus, the cylindrical rollers in the return portion do not support the load on the rail. Preferably a frontmost and/or rearmost section of the raceway member additionally slants slightly upwards towards the return surface, so as to achieve a smooth unloading of the roller that is exiting the work portion.

The invention according to the first aspect furthermore provides the use, onboard a vessel, of an assembly comprising an endless chain of linear recirculating cylindrical rollers, for example the assembly as described herein, for supporting an object on a rail that is mounted to the vessel, e.g. to a deck thereof, whilst moving the object along the rail in an X-Y plane of the vessel. As discussed, the use of the assembly may advantageously obviate the use of wheels and therefore reduce or eliminate the mentioned disadvantages associated with such wheels, as one or more assemblies may be used instead of wheels. The assembly as described is particularly suited for the use, because the load of the object is distributed evenly over the rollers, which may be crucial in view of the generally immense weight of the objects to be handled in offshore applications—for example, foundations or wind turbines, or parts thereof.

The invention according to the first aspect furthermore provides a system of one or more rails adapted to be mounted to a vessel, e.g. to a deck thereof, and one or more assemblies for supporting an object on the one or more rails whilst the object moves along the one or more rails. The one or more assemblies are preferably embodied as described herein before. For example, the system comprises two or more rails in parallel, which are each engaged by one or more respective assemblies. Thus, the load of the object may be distributed over the assemblies.

Each assembly is configured to engage with one of the rails and comprises a central body for engaging and carrying the object on the assembly, e.g. for mounting the object to the assembly.

Each assembly comprises an endless chain of cylindrical rollers, which are arranged for recirculating along a closed path defined by the assembly. The path includes a work portion and a return portion. The work portion is defined by a load bearing surface of the assembly, in which work portion an operative set of the cylindrical rollers engages the rail. In the return portion, a returning portion of the cylindrical rollers is free from the rail.

Preferably each assembly comprises a resilient insert via which the central body is resiliently supported on the raceway member and thus on the operative set of the cylindrical rollers, as described herein before.

The invention according to the first aspect furthermore provides a construction for supporting an object on a vessel, which comprises two systems as described, namely a first and a second system. Of the first system, the one or more rails are one or more first rails which extend in a first direction, and the one or more assemblies are one or more first assemblies.

Of the second system, the one or more rails are one or more second rails which extend in a second direction at an angle with the first direction, and the one or more assemblies are one or more second assemblies. The construction is configured to support the object on the one or more first rails via the one or more first assemblies and the one or more first rails are supported on the one or more second rails via the one or more second assemblies, so that the object is movable along the rails in both the first and the second direction. Thus, the object can be moved in both the first and the second direction, so that combined movements in the X-Y plane are possible.

In an embodiment according to the first aspect of the invention, the first rails are directly mounted on the one or more second assemblies in order to be supported on the one or more second rails.

In another embodiment according to the first aspect of the invention, the construction further comprises a positioning frame, via which the one or more first rails are mounted on the one or more second assemblies, so that the first system, and thereby the object, is moveable over the one or more second rails by moving the positioning frame over the one or more second rails.

Preferably, the first direction is perpendicular to the second direction, so that the directions follow, and can advantageously be controlled as in, a conventional coordinate system. For example, the construction can be such that when placed on a vessel, the first direction corresponds to the X-direction of the vessel, i.e. the longitudinal axis of the vessel, and the second direction corresponds to the Y-direction of the vessel. In an embodiment, the first and second rails are both straight, e.g. extending perpendicularly to one another. In another embodiment, one or more of the first and/or of the second rails are curved, for example forming a circle segment, for example for enabling rotation of an object supported thereon.

The first aspect of the invention furthermore provides a combination of an object and a system as described above, or a construction as described above.

In the combination as described, and in the inventive construction as described, the object is a tool for handling an offshore structure, e.g. an elongate offshore structure, e.g. the tool being a pile holding tool for handling a pile, e.g. a pile adapted to support an offshore wind turbine, wherein the combination further comprises one or more actuators for moving the tool over the one or more rails, and thus relative to the vessel, when mounted to the vessel.

In an embodiment according to the first aspect of the invention, the tool is resiliently mounted on the one or more assemblies. Thereby, the load of the tool can advantageously be distributed evenly over the assemblies.

In an embodiment according to the first aspect of the invention, the combination is configured for holding a pile at a vessel, e.g. a pile adapted to support an offshore wind turbine, e.g. for holding the pile during installation of the pile at an offshore location next to the vessel. Therein, the object to be supported on the one or more rails by the assemblies is a pile holding tool. A pile holding tool is known in the art to comprise a support structure and a pile holder, mounted to the support structure. The pile holder comprises a ring, and is configured to hold a pile in at least a vertical orientation with that ring. The ring comprises multiple pile engaging devices distributed about the circumference of the ring, each pile engaging device being adapted to engage an exterior of a pile extending through the ring, e.g. each pile engaging device comprising one or more pile guiding rollers.

In the combination, the support structure of the pile holding tool is mounted on the one or more assemblies.

In an embodiment according to the first aspect of the invention, the combination is a combination of a tool for handling an offshore structure, for example the pile holding tool as described, and the construction as described. Therein, the construction further comprises a positioning frame, via which the one or more first rails are mounted on the one or more second assemblies, so that the first system, and thereby the object, is moveable over the one or more second rails by moving the positioning frame over the one or more second rails. For moving the tool in the second direction, the actuators engage the positioning frame so as to move the positioning frame, and therewith, the first system and the tool over the one or more second rails. For moving the tool in the first direction, the actuators engage the tool, so as to move the tool over the one or more first rails.

In an embodiment according to the first aspect of the invention, the combination is configured to, when the combination is mounted to the vessel, maintain a predetermined X-Y location of the pile holder independent of the motion of the vessel, the vessel being in floating condition, by the actuators moving the pile holder over the one or more first rails and the one or more second rails, and thus relative to the vessel. Means for maintaining a predetermined X-Y location are known in the art for vessel-mounted pile holding tools.

In an embodiment according to the first aspect of the invention the combination comprises an active motion compensating actuation system for moving the support structure over the rails, and thus relative to the vessel, the active motion compensating actuation system comprising the one or more actuators. The actuators comprise a first actuator, e.g. a cam track mountable to the deck of the vessel and a drive mounted on the positioning frame engaging the cam track, for moving the positioning frame over the one or more first rails, and a second actuator, e.g. a cam track mounted on the support structure and a drive mounted on the positioning frame engaging the cam track, to move the support structure over the one or more second rails. The actuation system comprises an active wave-induced motion compensation mode in which the actuation system is operated to maintain a predetermined X-Y location of the pile holding tool independent of the motion of the vessel.

In an embodiment according to the first aspect of the invention, the ring of the pile holder comprises a ring base and one or more movable jaws, e.g. two semi-circular jaws, each jaw being movable between a closed position, wherein the ring forms a closed annulus, and an opened position. Such a pile holder is known, e.g. from WO2019125172.

The assemblies according to the first aspect of the invention, in particular the use thereof in a system or construction according to the first aspect of the invention, is furthermore envisaged for application with a lifting tool, e.g. a lifting beam, which is to be suspended from a lifting device, e.g. a crane, e.g. from one or more hoisting cables thereof. The lifting tool, configured to engage a load to couple with the load, can therein be connected to the assemblies, while the rail is connected to the lifting device, e.g. the hoisting cables thereof, e.g. indirectly connected. Moving the load over the rail via the assemblies, e.g. by means of an actuator, moves the load relative to the lifting device, so as to enable a change in the position and/or orientation of the load relative to the lifting device.

The assemblies according to the first aspect of the invention, in particular the use thereof in a system or construction according to the first aspect of the invention, is furthermore envisaged for application in a lift-removal of an offshore platform, e.g. a topsides structure supported by a steel jacket with multiple legs, by means of a decommissioning vessel for that purpose—e.g. the pioneering spirit. The lift-removal operation involves giant beams to be slid in their longitudinal direction along deck connected first rails, for moving outer ends of the beams (further) outboard the vessel, towards pre-installed bearing brackets that are mounted on the upper sections of the steel jacket's legs. Horse shoes mounted to the outer ends of the beams are connected to the bearing brackets, after which the upper sections are lifted from the rest of the jacket—and thereby, the topsides structure is lifted therefrom. The vessel, and therewith the topside structure, is subsequently moved away from the jacket. The giant beams may furthermore be movable along second rails in a transverse direction as well. The assemblies according to the first aspect of the invention may be used between the beams and the first rails, and between the first and second rails.

The assemblies according to the first aspect of the invention are furthermore envisaged to be used in a particular construction according to the first aspect of the invention, between one or more first and second rails extending in respective directions, e.g. perpendicular directions. In this construction, other than in the earlier described construction, the first and second assemblies are both provided at a crossing of the first and second rails, in stacked unit. A lower portion of such unit is configured to engage one of the second, lower rails, by means of one or more of the second assemblies provided in the lower portion. An upper portion of the unit is configured to engage one of the first, upper rails, by means of one or more of the first assemblies provided in the upper portion. Inherently, the work portions of the first assemblies are directed to the first rails in order to engage these, and those of the second assemblies directed to second rails in order to engage these. In an embodiment, the portions of the stacked may be pivotable relative to one another, e.g. about a vertical swivel axis, in order to facilitate sliding over rails that have a varying orientation relative to one another along the track. In an embodiment, the first and second rails are both straight, e.g. extending perpendicularly to one another. In another embodiment, one or more of the first and/or of the second rails are curved, for example forming a circle segment, for example for enabling rotation of an object supported thereon.

The to the first aspect of the invention furthermore provides a vessel, e.g. a vessel for handling an offshore structure, e.g. a pile, at an offshore location, e.g. for installing the structure at the offshore location. The vessel may be a floating vessel, or e.g. a jack-up vessel. In an embodiment the vessel is provided with one or more systems according to the first aspect of the invention, wherein the one or more rails are mounted to the vessel, e.g. are a deck-mounted rails. In an embodiment the vessel is provided with one or more constructions according to the first aspect of the invention, wherein the one or more second rails are mounted to the vessel, e.g. are deck-mounted rails, and wherein preferably the first direction is an X-direction of the vessel and the second direction is a Y-direction of the vessel. In an embodiment the vessel is provided with one or more combinations according to the first aspect of the invention, wherein the one or more rails, i.e. the one or more first rails, when present, are mounted to the vessel, e.g. are deck-mounted rails, and wherein when present, preferably the one or more first rails extend in the X-direction of the vessel and the one or more second rails in the Y-direction of the vessel.

In an embodiment according to the first aspect of the invention, the vessel is provided with a combination of a pile holding tool and the system or construction according to the first aspect of the invention, and the pile holding tool is moveable along the one or more rails between a stowed position in which the a ring of the pile holder extends, seen in the X-Y plane of the vessel, within the contour of the vessel, and an operational position, in which the ring of the pile holder extends, seen in the X-Y plane of the vessel, outboard the vessel. The stowed position enables a more compact and stable vessel when the pile holding tool is not being used, and enables to access the parts of the tool from the deck, e.g. for maintenance.

The first aspect of the invention furthermore provides a method for handling an object on a floating vessel, wherein use is made of a vessel according to the first aspect of the invention.

The first aspect of the invention furthermore provides a method for handling an object on a floating vessel, comprising:

- supporting an object on one or more rails mounted to offshore vessel, via one or more assemblies comprising an endless chain of linear recirculating cylindrical rollers, and
- moving the object along the one or more rails, and therewith, relative to the vessel, which moving involves for one or more of the assemblies, recirculating the endless chain of linear recirculating cylindrical rollers along a closed path defined by each assembly, an operative set of the cylindrical rollers engaging the rails and moving in a direction opposite to the movement of the object. Therein, the assemblies may each be according to the first aspect of the invention.

The methods according to the first aspect of the invention advantageously provide an alternative to the use of wheels, so that they may obviate the use thereof, and therewith, reduce or eliminate the advantages associated therewith.

In an embodiment according to the first aspect of the invention, the one or more rails comprise one or more first rails which extend in a first direction, and one or more second rails which extend in a second direction at an angle with the first direction, and the one or more assemblies comprise one or more first assemblies, and one or more second assemblies. The object is supported on, and moves over, the one or more first rails via the one or more first assemblies, and the one or more first rails are supported on, and move over, the one or more second rails via the one or more second assemblies, so that the object is movable along the rails in both the first and the second direction. Preferably, the second direction is perpendicular to the first direction. The moving along the one or more second rails of the object, the one or more first rails and assemblies, and thereby the object, is done by moving a positioning frame, via which the one or more first rails are mounted on the one or more second assemblies, along the one or more second rails.

In an embodiment according to the first aspect of the invention, the movement of the object is actuated such as to compensate for motions of the vessel in the X-Y plane of the vessel.

In an embodiment according to the first aspect of the invention, the object is a pile holding tool, and the supporting of the object comprises supporting on the one or more rails, i.e. on the first rails, when present, a support structure of the pile holding tool. The support structure is mounted on the one or more assemblies, i.e. on the one or more first assemblies, when present, and supports a pile holder of which a ring extends outboard of the vessel. Therein the method further comprises:

holding a pile, e.g. a pile adapted to support a wind turbine, such that it extends in a vertical orientation through the ring of the pile holder of the pile holding tool, wherein pile engaging devices distributed about the circumference of the ring engage the exterior of the pile, and lowering the pile into a body of water on which the vessel is floating while being held and guided by the pile engaging devices, wherein the motion compensation is executed at least during the lowering of the pile.

In an embodiment according to the first aspect of the invention, the movement of the pile holding tool is furthermore actuated such as to include, prior to at least the lowering of the pile, moving the pile holder from a stowed position, in which the a ring of the pile holder extends, seen in the X-Y plane of the vessel, within the contour of the vessel, to an operational position, in which the ring of the pile holder extends, seen in the X-Y plane of the vessel, outboard the vessel. In an embodiment, the movement of the pile holding tool is furthermore actuated such as to include, after at least the lowering of the pile and releasing the pile from the pile holder, including disengaging the pile engaging devices from the pile, moving the pile holder from the operational position to the stowed position.

In an embodiment according to the first aspect of the invention, the moving of the tool over the one or more rails may be actuated to include correcting, e.g. damping, of any displacement of the tool due to accidental bumping of the pile against the ring when the pile is being inserted into the ring prior to the lowering of the pile. Therein, the cylindrical rollers may or may not roll over the rails, for example the rotation thereof is locked so that these slide over the rails. Furthermore, while the pile is being held by the pile holder, e.g. while the pile is being lowered, the moving may be actuated to correct an undue tilting or an undue displacement of the monopile, e.g. as a consequence of sea motions or the influence of wind. For example, a toppling forward of the pile may be corrected by moving the pile holder forwards.

In an embodiment according to the second aspect of the invention, the cooperating releasable securing members comprise first securing members, e.g. eye members, integral with the ring base and located at multiple distinct angle positions, e.g. at three distinct angle positions, seen in plan view, and second securing members, e.g. eye members, integral with the support assembly and located at multiple distinct angle positions, e.g. at two distinct angle positions, seen in plan view, so as to allow for three distinct mounting angle positions of the ring relative to the support assembly.

In an embodiment according to the second aspect of the invention, the cooperating releasable securing members comprise first eye members integral with the ring base, and second eye member integral with the support assembly, and the cooperating releasable securing members comprise pins that are configured to be fitted through a set of aligned first and second eye members.

In an embodiment according to the second aspect of the invention, the support assembly is an X-Y motion compensation support assembly that is configured to provide compensation for motion of the vessel in a plane of the ring to maintain a predetermined X-Y location of the pile holder independent of motion of the vessel.

In an embodiment according to the second aspect of the invention, the support assembly comprises one or more first rails to be mounted on, or mounted on the vessel, e.g. on a deck of the vessel, a positioning frame movably supported on said one or more first rails in a first direction, where the positioning frame is provided with one or more second rails extending in a second direction, e.g. perpendicular to the first direction, and a support frame movably supported on said one or more second rails in said second direction, wherein the ring base of the ring of pile holder and the support frame are provided with said cooperating releasable securing members that are configured to provide multiple distinct mounting angle positions, seen in plan view, of the ring relative to the support frame.

In an embodiment according to the second aspect of the invention, the pile holding system is further embodied with one or more bumper devices as disclosed herein with reference to the fourth aspect of the invention, and/or embodied as described herein with a support assembly according to the first aspect of the invention.

It is furthermore submitted that, for example on multipurpose vessels, pile holding systems are often configured to be temporarily mounted on the deck of the vessel. The pile holding system can thus be removed from the vessel when the vessel is to be used for business other than installation of piles, for example when the vessel is used for transporting and installation of foundations in the form of jackets.

Providing the pile holding system with distinct mounting angle positions of the ring relative to the support assembly allows for the pile holding system to be mounted at different positions relative to a crane, i.e. the crane for supporting a pile to be guided by the pile holding system, with the ring in an optimal introduction position, i.e. a position that allows for the crane to introduce the pile into the ring by only slewing the crane or by only tilting the boom of the crane, or by mainly slewing of the crane or by mainly tilting the crane in combination with a minimum of tilting of the boom or a minimum of slewing of the crane respectively.

For example, the invention enables a pile holding system that can be mounted on opposite sided of a crane, wherein the ring, more in particular the opening of the ring when the one or more pivotable jaws of the ring are in the are in the opened position, can face towards a pile being moved by the crane from an upending position towards the pile holding system.

In an embodiment according to the second aspect of the invention, the ring can be mounted in the support assembly in a central position, in which the opening faces away from the support assembly and the ring base is positioned between the opening and the support assembly, in a left facing, or counter clockwise, position, in which the opening of the ring faces towards the left of the central position when seen in pan view, and in a right facing, or clockwise, position, in which the opening of the ring faces towards the right of the central position when seen in pan view.

In an embodiment according to the second aspect of the invention, the cooperating releasable securing members are configured to quickly disconnect and to thus separate the ring from the support assembly. For example, in case the vessel on which the pile holding system is to be moved away from the pile quickly. In an embodiment, the cooperating releasable securing members are explosive bolts.

In an alternative embodiment, the ring and/or the support assembly are configured to quickly disconnect from the releasable securing members, to thus quickly separate the ring form the support assembly. For example, in an embodiment the releasable securing members comprise eyes mounted to a beam that is part of the support assembly, which beam can be quickly disconnected from the support assembly, for example is mounted to the support assembly with explosive bolts.

In a further embodiment according to the second aspect of the invention, the releasable securing members and/or the support assembly are furthermore configured to push the ring away from the support assembly, and thus push the ring away from the vessel, once the ring is disconnected from the support assembly or just prior to the ring being disconnected from the support assembly.

For example, in an embodiment, the support assembly comprises one or more rails that, when the holding system is mounted on a vessel, extend substantially perpendicular to an edge of the vessel, i.e. an edge of the deck onto which the pile holding system is mounted, and a top part of the support assembly, the top part comprising the cooperating releasable securing members, is movably supported on the rails. Furthermore, a drive is provided to move the top part of the support assembly along the track. Thus, the top part of the support assembly can be moved in a direction perpendicular to the edge of the deck of the vessel to thus move the ring away from the deck of the vessel, i.e. away from the vessel. In addition or as an alternative pushing means can be provided in the form of electric spindles, hydraulic cylinders, etc configured for pushing the ring away from the support assembly According to the second aspect, the invention furthermore provides a pile holding system comprising:

- a support assembly configured to be mounted on the vessel, e.g. on a deck of the vessel,
- a pile holder mounted on the support assembly, wherein the pile holder is configured to hold a pile in a vertical orientation, wherein the pile holder comprises at least one ring, which is provided with multiple pile engaging devices distributed about a circumference of the ring, each pile engaging device being adapted to engage an exterior of a pile extending through the ring, e.g. each pile engaging device comprises one or more pile guiding rollers, wherein the ring comprises a ring base that is secured to the support assembly and one or more pivotal jaws, e.g. two semi-circular jaws, each jaw being pivotally mounted at an inner end thereof to the ring base and having an outer end, the one or more jaws being movable between a closed position, wherein the respective ring forms a closed annulus, and an opened position, wherein an opening is present allowing for introduction of the pile into the pile holder, and wherein the ring base of the ring and the support assembly are provided with cooperating releasable securing members that are configured to quickly disconnected, to thus disconnect the ring from the support assembly, and preferably wherein the releasable securing members and/or the support assembly are furthermore configured generate a pushing force, to push the ring away from the support assembly, and thus away from the vessel, once the ring is disconnected from the support assembly or just prior to the ring being disconnected from the support assembly.

The second aspect of the invention also relates to a vessel, e.g. a jack-up vessel, provided with a pile holding system, e.g. for installation of a pile adapted to support an offshore wind turbine, e.g. a monopile.

The second aspect of the invention also relates to a method for installation of a pile of an offshore wind turbine, wherein use is made of:

- a vessel having a hull with a deck and a side, e.g. a jack-up vessel,
- a crane erected on the deck of the vessel and having a boom that is slewable by a slew drive of the crane about a vertical slew axis and that is luffable about a boom axis by a luffing mechanism of the crane, which crane is configured to hoist and suspend the pile,

- a pile holding system according to the second aspect of the invention, wherein the method comprises lateral introduction of the pile when suspended vertically from the crane into the opened annulus of the ring.

In an embodiment according to the third aspect of the invention, the upending tool is mounted on said deck of the vessel on one side of the crane, within reach of the crane, and wherein the pile holding system is mounted on said deck of the vessel on another side of the crane, within reach of the crane.

In an embodiment according to the third aspect of the invention, the support assembly is provided with a ring positioning system configured to move the ring relative to the crane of the vessel in a direction parallel to the edge of the vessel and perpendicular to the vessel, to enable the support assembly to position the ring relative to the crane in a position that matches with a slewing movement of the crane that originates at a upending device. Thus, the position of the ring can be adjusted to fit the slewing movement of the crane, the slewing movement of the crane moving a pile from an upending device to the pile holding system, originating at an alternative or repositioned upending device. therefore it is not necessary to reposition the support assembly.

For example, in an embodiment according to the third aspect of the invention, the pile holding system is set up in front of the crane, i.e. between the crane and the side of the vessel with the ring mounted to the support assembly for receiving piles from a upending device set up at the left of the crane. In this embodiment, the ring is mounted on the support assembly in a position with the opening of the ring facing towards the left of the crane.

When subsequently an upending device set up at the right of the crane is to be used, the ring of the pile holding system is remounted on the support assembly such that the opening of the ring now faces towards the right of the crane. In addition, the ring positioning system may adjust the position of the ring such that a pile can be moved form the upend device and introduced into the ring of the pile holding system by a slewing movement of the crane only. In a further embodiment, for use with a floating vessel, the support assembly comprises a positioning system that is configured to position the ring of the pile holding system relative to the vessel while guiding a pile, to compensate for movement of the vessel, i.e. sea induced movements of the vessel, relative to the pile installation site, i.e. to location where the pile is to be driven into the sea floor. Preferably, in such an embodiment, the positioning system is configured for, i.e. comprises a range of movement that is sufficient for, adjusting the position of the ring to fit a pile introduction trajectory originating with an alternative or repositioned upending device and for correcting for movement of the vessel relative to the pile installation site.

In a further method according to the third aspect of the invention, use is made of a pile holding system according to the second aspect of the invention.

In a further embodiment, a method according to the third aspect of the invention comprises:

mounting the support assembly of the pile holding assembly on the deck of the vessel, and mounting the ring of the pile holding system on the support assembly in a position for introducing the pile into the ring by only slewing the crane.

In an embodiment the ring base is provided with two bumper devices, each bumper device comprising a bumper beam that is at one end pivotally secured to an end portion of the ring base about a vertical axis, so that the free ends of the bumper beams are directed towards one another seen in plan view, and wherein the actuator is configured to pivot the bumper beam relative to the ring base.

In an embodiment, seen in plan view, each bumper beam has a front side facing the pile that comprises a first front side portion and a second front side portion that are inclined relative to one another.

The fourth aspect of the invention also relates to a vessel, e.g. a jack-up vessel, provided with a pile holding system, e.g. for installation of a pile adapted to support an offshore wind turbine, e.g. a monopile.

The fourth aspect of the invention also relates to a method for installation of a pile of an offshore wind turbine, wherein use is made of:

a vessel having a hull with a deck and a side, e.g. a jack-up vessel, a crane erected on the deck of the vessel and having a boom that is slewable by a slew drive of the crane about a vertical slew axis and that is luffable about a boom axis by a luffing mechanism of the crane, which crane is configured to hoist and suspend the pile, a pile holding system according to the fourth aspect of the invention, wherein the method comprises lateral introduction of the pile when suspended vertically from the crane into the opened annulus of the ring, wherein the one or more bumper devices in their operable position act as a bumper for the pile, e.g. avoiding any collision between the pile and the one or more pile engaging devices mounted on the ring base.

It is submitted that the bumpers according to the fourth aspect of the invention can also be used in a ring of a pile holding system according to the second or fifth aspect of the invention, or in a ring that is used in a method according to the fourth aspect of the invention.

In an embodiment of a pile holding system according to the fifth aspect of the invention, the ring is provided with an semi-circular track, having a center that coincides with the central axis of the ring, wherein the semi-circular track is received in a guide mounted on the support assembly, such that by moving the track through the guide, the ring is rotated about the central axis.

In an embodiment of a pile holding system according to the fifth aspect of the invention, the ring can be rotated about the central axis over an angle of at least 40 degrees, preferably of at least 60 degrees.

In an embodiment of a pile holding system according to the fifth aspect of the invention, the ring can be rotated about the central axis from a central position, in which the opening faces away from the support assembly and the ring base is positioned between the opening and the support assembly, towards the left, i.e. counter clockwise when seen in plan view, over an angle of at least 20 degrees, preferably of at least 30 degrees, for example of at least 40 degrees, and towards the right, i.e. clockwise when seen in plan view, over an angle of at least 20 degrees, preferably of at least 30 degrees, for example of at least 40 degrees.

In a further embodiment of a pile holding system according to the fifth aspect of the invention, the ring can be rotated over an angle of one hundred and eighty degrees. Such an embodiment allows for introducing a pile on one side of the pile holding system, for example by introducing the pile into the ring from the left side of the pile holding system, in a direction parallel to the side of the vessel, and for removing the pile from the ring towards the right of the pile holding assembly, also in a direction parallel to the side of the vessel.

In a further embodiment of a pile holding system according to the fifth aspect of the invention, the support assembly is mounted on a semi-circular track, which semi-circular track is configured to be mounted or is mounted on the deck of a vessel, wherein the semi-circular track is has a center that coincides with the central axis of the ring of the pile holding system.

In an embodiment of a pile holding system according to the fifth aspect of the invention, the pile engagement devices of the pile holding system are mounted on semi-circular tracks provided on the ring. Thus, the pile engagement holding devices can be moved relative to the ring, about the central axis of the ring. Such an embodiment allows for moving the pile engagement devices of the ring in a counter clockwise direction relative to the ring, while the ring is rotated clockwise, or vice versa respectively. Thus, the opening of the ring can be repositioned, for example can be moved relative to the support system from a left facing position towards a right facing position, while the pile engagement device maintain there position relative to the pile support system. Thus, the ting can be repositioned while a pile received in the ring maintains it position, i.e. is not rotated about its vertical axis.

BRIEF DESCRIPTION OF THE DRAWINGS

The invention is hereinafter described with reference to the appended drawings. In the drawings, FIGS. 1*a,b* illustrate, in a side view, a combination according to the first aspect of the invention, respectively in a stowed position and an operational position, FIG. 4 illustrates in the view of FIG. 3*a*, the same assembly in operation on a rail, FIG. 9 illustrates, in a side view, a longitudinal cross-section through a system according to the first aspect of the invention, FIG. 10 illustrates a bottom view of the same system, FIG. 11 illustrates a vessel according to the invention and a method according to the first aspect of the invention, FIG. 12*a-b* schematically illustrate exemplary constructions according to the first aspect of the invention.

It is noted, that the figures are schematical representations of the first aspect of the invention, and may e.g. not all be true to nature or scale.

DETAILED DESCRIPTION OF EMBODIMENTS

Figure 1A:
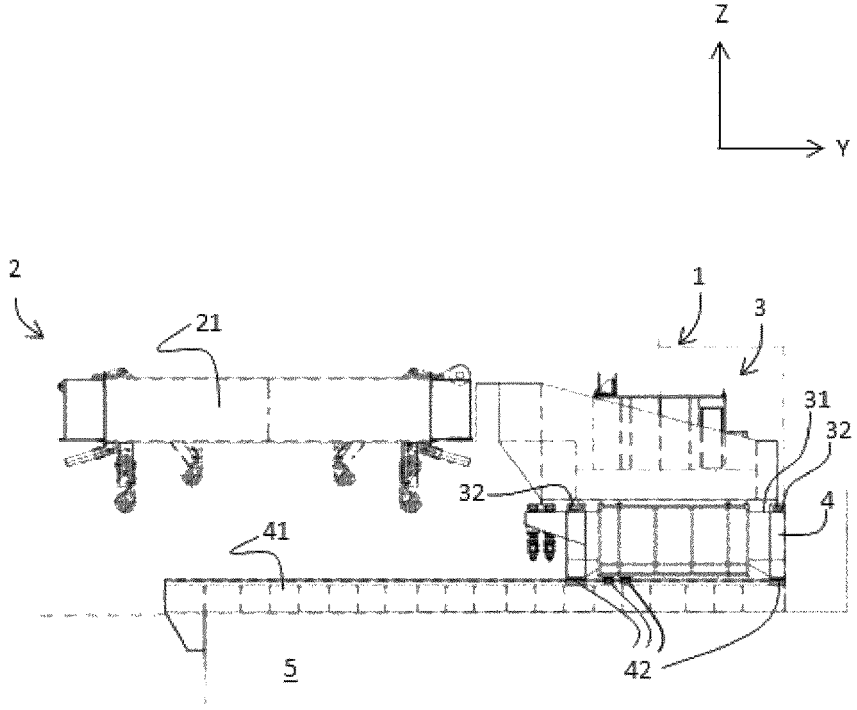
FIG. 1*c* illustrates, in a top view with a detail, the same combination, FIGS. 2*a,b* illustrate, in a top and side view, a combination according to the first aspect of the invention, respectively in a stowed position and an operational position, FIGS. 3*a,b* illustrate, in a side view, a longitudinal cross-section through an assembly according to the first aspect of the invention.
Figure 1B:
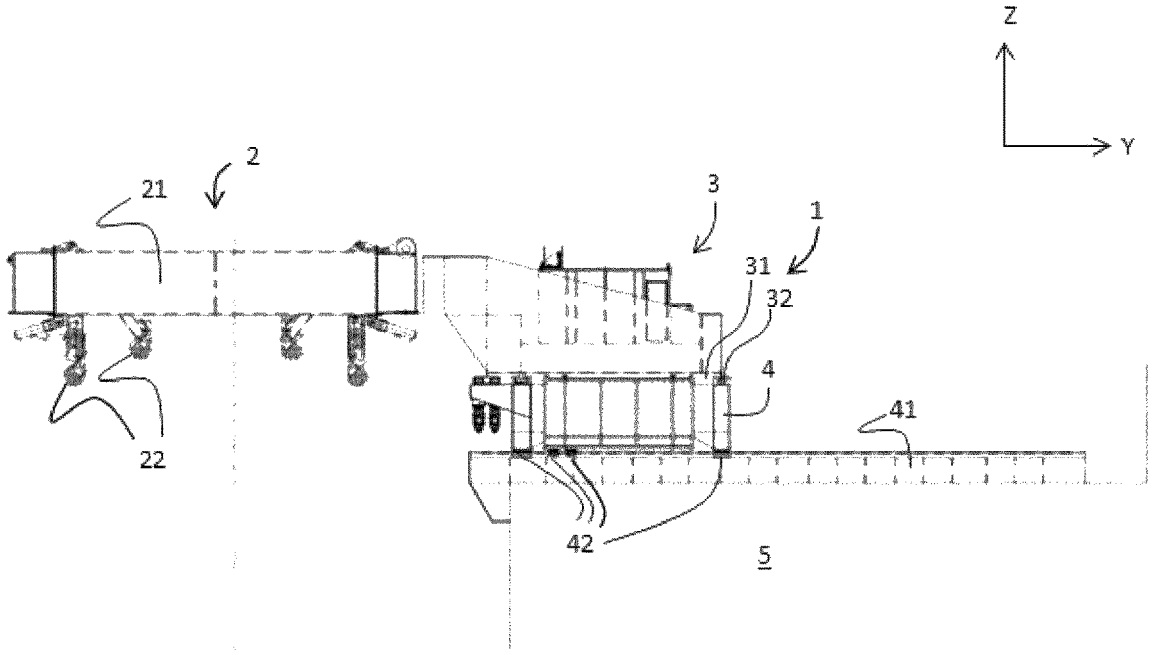
Figure 1C:
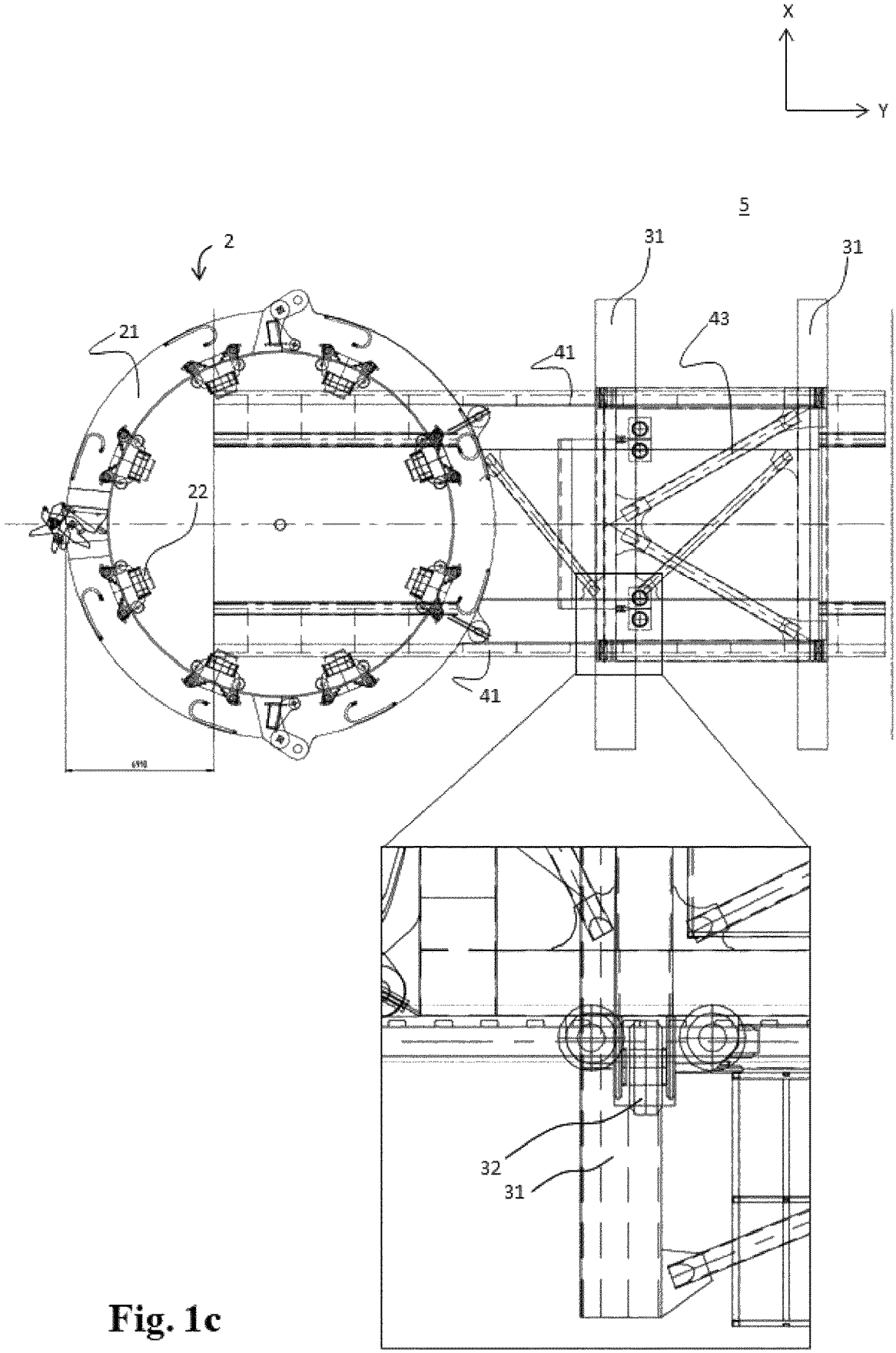
Figure 7:
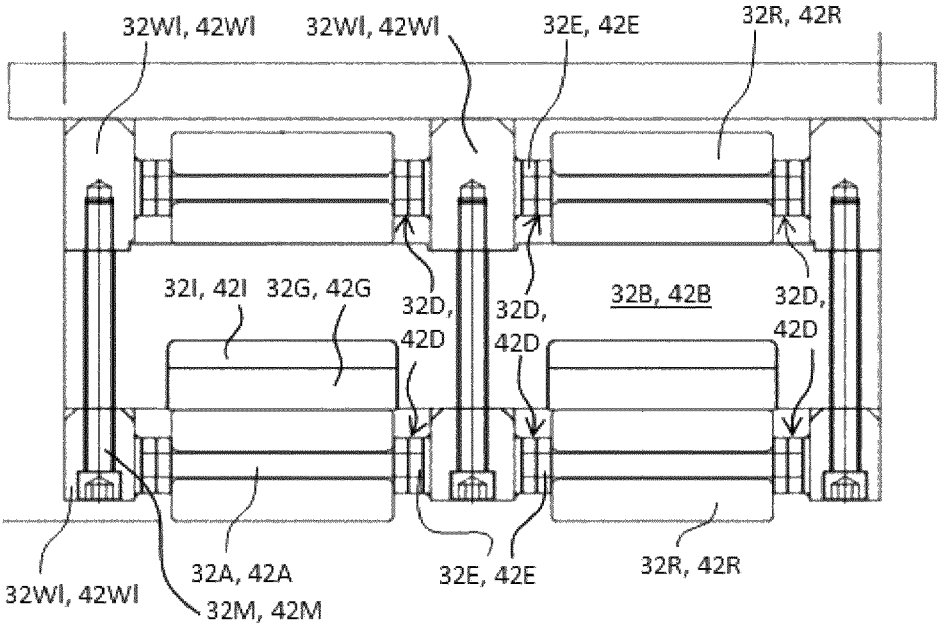
FIG. 7 illustrates, in a front view, a lateral cross-section of the assembly.

FIGS. 1*a*, 1*b* and 1*c* show an illustrative combination 1 according to the first aspect of the invention, namely a combination of an pile holding tool 2,3 and a construction 4,31,32,41,42 according to the first aspect of the invention. The tool is suitable for handling a pile 6, in particular a pile adapted to support an offshore wind turbine. The combination 1 is to be mounted on a vessel 5, as is shown in FIG. 7 for a jack-up vessel 5 which is suitable for handling and installing the pile at an offshore location next to the vessel. The combination 1 may however also be mounted on a floating vessel (not shown), e.g. suitable for such handling and installation of offshore structures.

The construction comprises a first and second system according to the first aspect of the invention. The first system comprises two parallel first rails 31 which extend in a first direction X, and multiple assemblies 32 according to the first aspect of the invention which each engage one of the rails 31. The second system comprises two parallel second rails 41 which extend in a second direction Y, which is perpendicular to the first direction, and multiple assemblies 42 which each engage one of the second rails 41.

The construction is configured to support the pile holding tool 2,3 on the one or more first rails 31 via the one or more first assemblies 32, and the one or more first rails 31 are supported on the one or more second rails 41 via the one or more second assemblies 42, onto which the first rails 31 are both mounted via a positioning frame 4. Thereby, the tool 2,3 is movable along the rails 31,41 of the construction in both the first and the second direction X,Y. The combination further comprises one or more actuators 43 for moving the tool 2,3 over the one or more rails 31,41. When mounted to the vessel 5 as in FIG. 7, the rails 31,41 may in particular extend in the X,Y direction of the vessel 5 as shown, respectively. Therein, moving the tool over the rails 31,41, moves the tool 2,3 relative to the vessel 5 in these directions.

The pile holding tool 2,3 supported on the construction comprises a support structure 3, which is mounted on the one or more assemblies 31,41, and a pile holder 2. The pile holder is mounted to the support structure 3, and comprises a ring 21. The pile holder 2 is configured to hold a pile 6 in at least a vertical orientation with that ring 21, as shown in FIG. 7. The ring 21 comprises multiple pile engaging devices 22 distributed about the circumference of the ring 21. Each pile engaging device 22 is adapted to engage an exterior of a pile 6 extending through the ring 21 and comprises one or more pile guiding rollers.

The combination 1 is configured to, when mounted to a vessel, maintain a predetermined X-Y location of the pile holder 2,3 independent of the motion of the vessel by the actuators moving the pile holder 2,3 over the one or more first rails 31 and the one or more second rails 41, and thus relative to the vessel. This is of particular use when the vessel is in floating condition and subject to motions of the sea, e.g. currents and waves, and wind. The combination may comprise an active motion compensating actuation system for moving the support structure 3 over the rails 31,41, and thus relative to the vessel.

As shown in FIGS. 1*a* and 1*b*, the pile holding tool 2,3 is moveable along the one or more rails 31,41 between a stowed position (FIG. 1*a*) and an operational position (FIG. 1*b*). As may be envisaged from FIG. 7, when the combination 1 is mounted to a vessel 5 in the manner as shown, in the stowed position (FIG. 1*a*) the ring 21 of the pile holder 2 extends, seen in the X-Y plane of the vessel 5, within the contour of the vessel 5, and in the operational position (FIG. 1*b*) the ring 21 extends, seen in the X-Y plane of the vessel 5, outboard the vessel 5. In the operation position, a pile 6 can be lowered through the ring 21 while being held by the pile engaging devices 22.

Figure 2A:
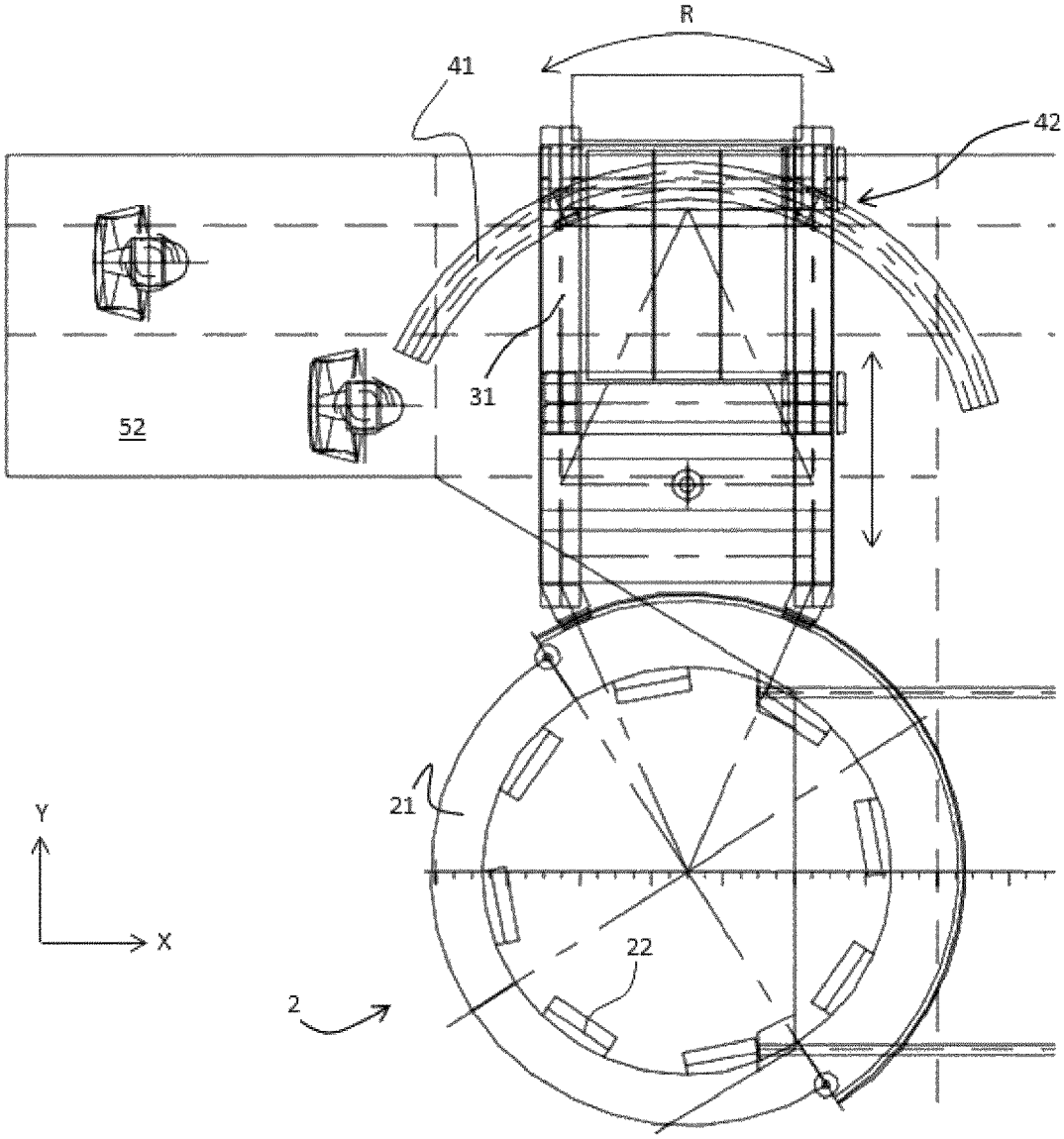
Figure 2B:
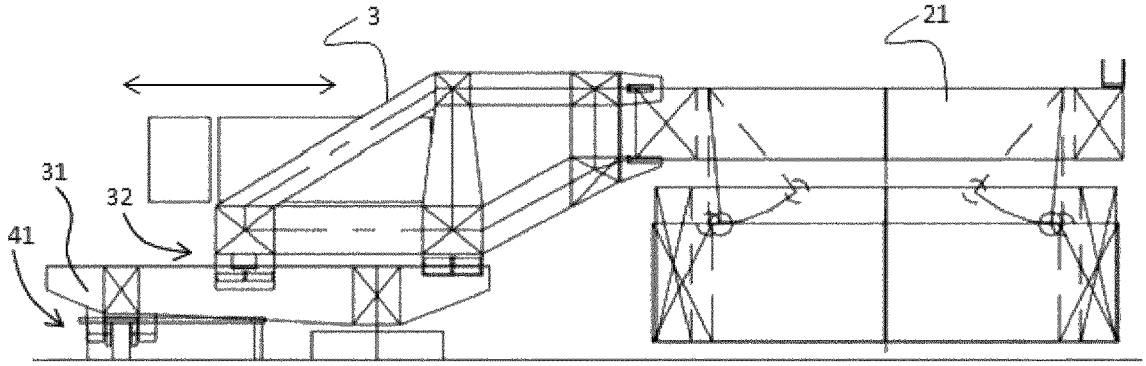

FIGS. 2*a* and 2*b* illustrate a combination 1 according to the first aspect of the invention wherein a similar pile holding tool 2,3 as shown in FIGS. 1*a-c* is supported on first rails 31, which are straight, and enable the stowed and operational position alike in FIGS. 1*a-b*. The second rail 41 is curved, forming a circle segment, for enabling rotation of the pile holding tool 2,3 supported thereon relative to the deck 51. A pile holder being supported on such straight rails, on top of curved rails, is known from the non-prepublished application NL2028124 by the applicant, along with the possibilities for movement of the pile holder along these rails.

FIGS. 3*a* and 3*b* show a single one of the assemblies 32,42 by means of which the pile holding tool 2,3 is supported on the rails 31,41. Both an assembly 32 onto which the support structure 3 of the tool 2,3 is mounted, and an assembly 42 onto which the positioning frame 4 is mounted, may be embodied as shown. Therefore, the indications in the figures refer both to an embodiment of an assembly 32 and of an assembly 42.

The assembly 32 or 42 comprises a load bearing housing 32H or 42H, with a top plate for carrying the tool 2,3 on the assembly 32 or 42.

The assembly 32,42 comprises an endless chain of steel cylindrical rollers 32R,42R, which are arranged for recirculating along a closed path 32P,42P around a steel raceway member 32G,42G and a steel central body 32B,42B of the assembly 32,42. The steel central body 32B, 42B is attached to the load bearing housing 32H, 42H via a number of elongate mounting elements, namely bolts 32M, 42M. The path 32P, 42P is indicated in FIG. 3*a* and FIG. 4. The path 32P,42P has a work portion 32Pw,42Pw defined by a flat load bearing surface 32L,42L of the steel raceway member 32G,42G of the assembly 32,42. The work portion 32Pw, 42Pw is indicated in FIG. 4 by the dashed rectangle. In this work portion 32Pw,42Pw, an operative set of the cylindrical rollers 32R,42R engages the rail 31,41. The path 32P,42P also has a return portion 32Pr,42Pr which is defined by a return surface 32T, 42T of the steel central body 32B, 42B of the assembly. In the return portion a remaining set of the cylindrical rollers 32R,42R is free from the rail 31,41. The return portion 32Pr,42Pr has a section which is parallel to the work portion 32Pw,42Pw. The work portion 32Pw,42Pw and the parallel section of the return portion 32Pr,42Pr are connected at the front and rear side of the assembly 32,42 by a respective front and rear semi-circular section to form the complete closed path 32P,42P.

The return surface 32T,42T, see FIG. 3*b*, defines the return portion 32Pr,42Pr of the closed path 32P,42P. The return surface is formed by the steel out of which the central body 32B,42B is made. The load bearing surface 32L,42L and the return surface 32T,42T define, at the side of the cylindrical rollers 32R,42R, respectively the work portion 32Pw,42Pw and the return portion 32Pr,42Pr of the path 32P,42P. The semi-circular sections connecting the parallel sections of the path 32P,42P are at the opposite side of the path defined by the front and back guide walls 32Wg,42Wg, see FIG. 3*a*, FIG. 5 and FIG. 9.

The assembly 32,42 comprises a resilient insert 321,421 in the form of a resilient plastic plate, e.g. made of a fibre reinforced plastic material, e.g. adapted for use in bearings. The central body 32B,42B via this resilient insert 321,421 and the raceway member 32G,42G resiliently supported on the operative set of the cylindrical rollers 32R, 42R, see FIGS. 3*a*,3*b* and 4. Thereto the resilient plate 321, 421 is sandwiched between the central body 32B, 42B and the raceway member 32G, 42G above the work portion 32Pw, 42Pw of the path 32P,42P.

The raceway member 32G,42G is in the form of a raceway plate 32G,42G, and is alike the central body 32B,42B also made of steel. It guides the operative set of the cylindrical rollers 32R,32R between the load bearing surface 32L, 42L of the raceway plate 32G,42G and an upper surface 31S,41S of the rail 31,41. The raceway plate 32G, 42G is disposed between the resilient insert 321,421 and the operative set of the cylindrical rollers 32R,42R, and defines, at the side of the operative set of the cylindrical rollers 32R,42R, the work portion 32Pw,42Pw of the path 32P,42P. In the shown embodiment, The raceway plate 32G,42G and the resilient insert 321,421 have the same dimensions in the axial plane and are stacked on top of each other such that their longitudinal and lateral edges axially coincide. The thickness of the raceway member 32G,42G is smaller than the thickness of the raceway member 32G,42G: it corresponds to around 60% of the thickness of the raceway member 32G,42G. The central body 32B,42B comprises a recess inside which the resilient insert 321,421 and the raceway plate 32G,42G are contained and axially enclosed. The raceway plate 32G,42G is flush with the longitudinally adjacent return surface 32T,42T of the central body 32B, 42B.

Figure 5:
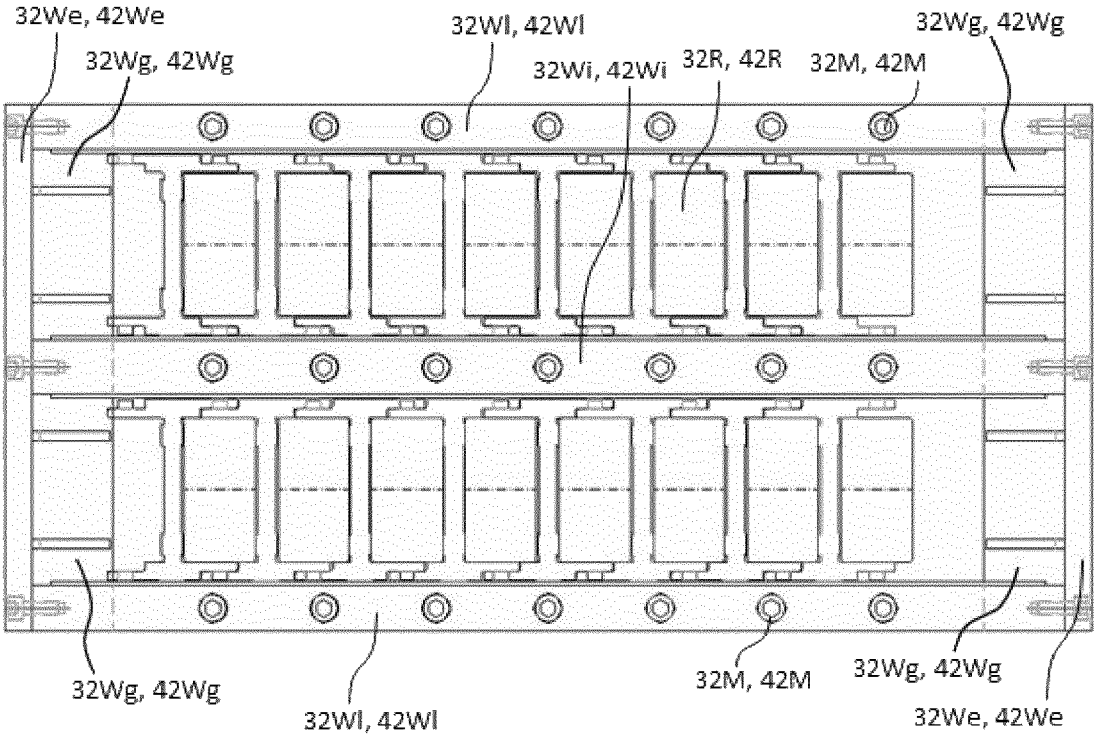
FIG. 5 illustrates in a top view, the same assembly.

As illustrated in FIGS. 5 and 7, an embodiment of an assembly 32,42 according to the first aspect of the invention may further comprise a second endless chain of linear recirculating cylindrical rollers 32R,42R, arranged for recirculating along a second closed path 32P,42P defined by the assembly 32,42. The two paths 32P,42P are laterally juxtaposed and parallel to one another. The second path 32P,42P, also includes a work portion 32Pw,42Pw in which an operative set of the cylindrical rollers 32R,42R engages the rail 31,41, and a return portion 32Pr, 42Pr in which a returning portion of the cylindrical rollers 32R,42R is free from the rail 31,41. The work portion 32Pw,42Pw of the second closed path 32P,42P is defined by a second load bearing surface of a second raceway member. The return portion of the second path 32P,42P is defined by a second return surface of the central body 32B, 42B. Thus the central body 32B,42B has in this embodiment two load bearing surfaces 32L,42L and two return surfaces 32T,42T defining the respective work portions 32Pw,42Pw and return portions 32Pr,42Pr, and is integral for association with both endless chains. The central body is here resiliently supported on the respective operative portions of the cylindrical rollers of both endless chains via the respective raceway members, a second resilient insert containing a plastic material being sandwiched between the central body (32B,42B) and the second raceway member.

The housing 32H,42H of the assembly 32,42 comprises a front and rear vertical end wall 32We,42We which extend laterally respectively at the front and rear side of the assembly, and a front and rear guide wall 32Wg,42Wg which are attached to respectively the front and rear end wall 32We,42We. The front guide wall 32Wg,42Wg defines a front section of the return portion 32Pr,42Pr of the closed path 32P,42P opposite the return surface 32T,42T, and the rear guide wall 32Wg,42Wg defines a rear section of the return portion of the closed path 32P,42P. The attachment is via multiple bolts which extend perpendicularly through the end walls and longitudinally stick into the guide walls.

Figure 8:
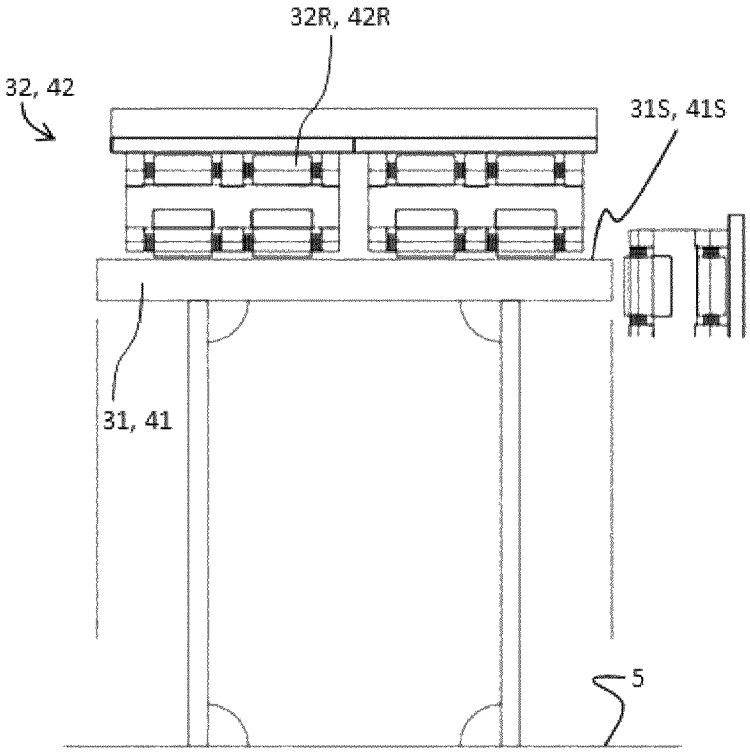
FIG. 8 illustrates, in a front view, a lateral cross-section of a system according to the first aspect of the invention.

In the embodiment with two endless chains, see FIGS. 5,7 and 8, the housing 32H,42H comprises a second front guide wall and a second rear guide wall, which are attached to respectively the front and rear end wall 32We,42We and define respectively a front and rear section of the return portion of the second closed path 32P,42P opposite the second return surface 32T,42T.

As shown best in FIG. 7 for the embodiment with two endless chains of cylindrical rollers 32R,42R, the cylindrical rollers 32R,42R of the assembly 32,42 each rotate around a respective roller axis 32A,42A of which head ends 32E,42E run over respective treads 32D,42D formed by vertical protrusions from the central body 32B,42B extending longitudinally along the closed path 32P,42P at respective lateral sides of the closed path 32P,42P.

FIG. 7 also shows that the assembly 32,42 comprises left upper and lower and right upper and lower longitudinal wall parts 32WI,42WI which form upper and lower vertical protrusions from the central body 32B,42B at the left and right ends thereof, and which extend longitudinally over at a least a length of the closed path 32P,42P. The left upper and lower wall part 32WI,42WI are interconnected via multiple bolts 32M,42M, see also FIG. 5, and the right upper and lower longitudinal wall parts 32WI,42WI are interconnected via multiple bolts as well. These bolts 32M,42M vertically extend inside the respective upper and lower longitudinal wall parts 32WI,42WI and run through the respective lateral end of the central body 32B,42B. FIG. 5 shows that the bolts 32M,42M are distributed longitudinally along the wall parts 32WI,42WI.

As indicated in the assembly 32,42 of FIGS. 9 and 10 in a side and bottom view, and visible in FIG. 4 as well, the housing 32H,42H of the assembly 32,42 may be provided, at least around the work portion of the recirculating cylindrical rollers 32R,42R, with seals 32S,42S between the end walls 32We,42We and longitudinal wall parts 32WI,42WI, and the upper surface 31S,41S of the rail 31,41. The walls 32We,32WI,42We,42WI and the seals 32S,42S define between the load bearing surface 32L,42L and the upper surface of the rail 31,41 a grease chamber 32H,42H for the operative set of the recirculating cylindrical rollers 32R,42R. The seals 31S,32S may in a cross-section thereof be substantially V-shaped—see FIG. 4.

The assembly 32,42 with two endless chains further comprises intermediate upper and lower longitudinal wall parts 32Wi,42Wi, see FIGS. 5 and 7, which form upper and lower vertical protrusions from the central body 32B,42B in between the two closed paths 32P,42P, and which extend longitudinally over at least a length of the closed path 32P,42P. The intermediate upper and lower longitudinal wall parts 32Wi,42Wi are interconnected via multiple bolts 32M, 42M, which vertically extend inside the respective upper and lower longitudinal wall parts 32WI,42WI and through a central part of the central body 32B,42B. FIG. 5 shows that these bolts 32M,42M are distributed longitudinally along the wall part 32Wi,42Wi.

The longitudinal wall parts 32WI,32Wi,42WI,42Wi are each connected to the end walls 32We,42We via bolts which extend perpendicularly through the end walls 32We,42We and longitudinally stick into the longitudinal wall parts 32WI,32Wi,42WI,42Wi. This is visible in FIG. 5.

As may be verified in FIGS. 3*a* and 3*b*, at a front and rear side of the load bearing surface 32L,42L, the return surface runs upwardly directly from the load bearing surface 32L, 42L. Furthermore a frontmost and/or rearmost section of the raceway member 32G,42G slants slightly upwards towards the return surface. Note that the upward slants are very subtle.

As shown in FIG. 9 (side view) and FIG. 10 (bottom view), the assembly 32,42 according to the first aspect of the invention may be provided at a front and rear side, facing a longitudinal direction of the rail 31,41, with a scraper 32C,42C engaging the upper surface 31S,41S of the rail 31,41 for cleaning the rail 31,41. The housing 32H,42H thereto further comprises a front and rear frame which protrude respectively from the front and rear end wall 32We,42We in a frontward and rearward direction. The front and rear scraper 32C,42C are mounted underneath the respective frame at a longitudinal end thereof.

Figure 6:
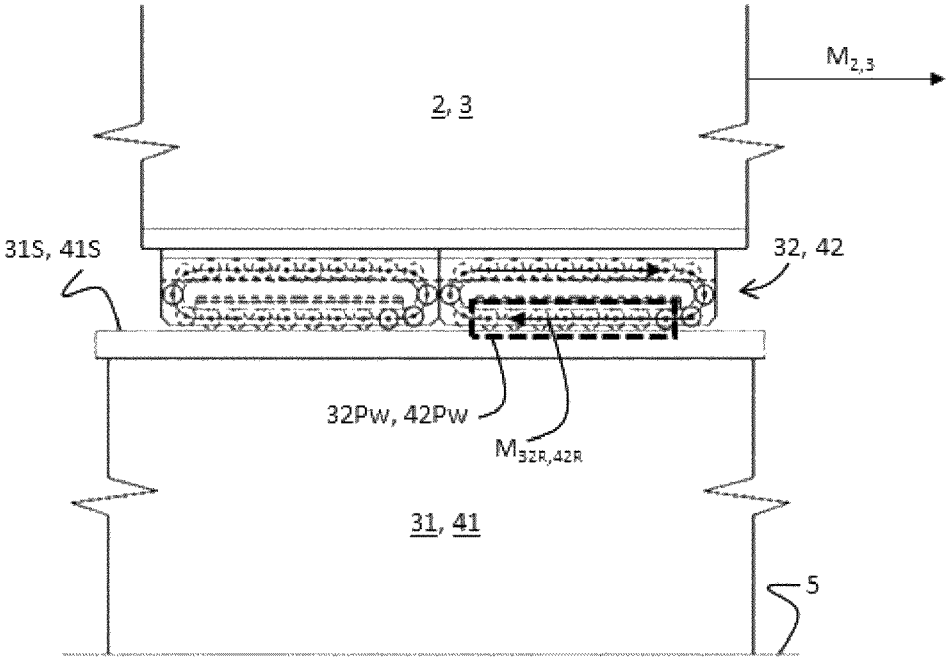
FIG. 6 illustrates in a side-cross-sectional view, two of the assemblies according to the first aspect of the invention in series being used in a combination according to the first aspect of the invention.

FIGS. 4,6 and 8 illustrate a system according to the first aspect of the invention of a rail and an assembly according to the first aspect of the invention.

FIG. 8 schematically illustrates, that in addition to the top surface 31S,41S of the rail, also a side surface of the rail, e.g. both side surfaces, may be engaged by a corresponding lateral guidance part of the assembly, for limiting lateral motion of the assembly, and therewith of the object 2,3, in lateral directions of the rail 31, 41. For example, as shown, a lateral guidance part comprises a sliding bearing and/or a roller arrangement, e.g. depending on load requirements.

FIG. 6 shows the use of two assemblies 32,42 in series, engaging a rail 31,41 mounted on a vessel 5, for supporting an object 2,3. The object is moving over the rail 31,41 in the indicated direction $M_{2,3}$, and the operative part of the cylindrical rollers 32R,42R moves in the opposite direction $M_{32R,42R}$ in the work portion 32Pw,42Pw of the closed path 32P,42P of the cylindrical rollers. The resilient insert 321, 421 facilitates a resilient support of the object 2,3 on the cylindrical rollers 32R,42R, and thus on the rail 31,41 while the object 2,3 moves over the rail 31,41.

Figure 12A:
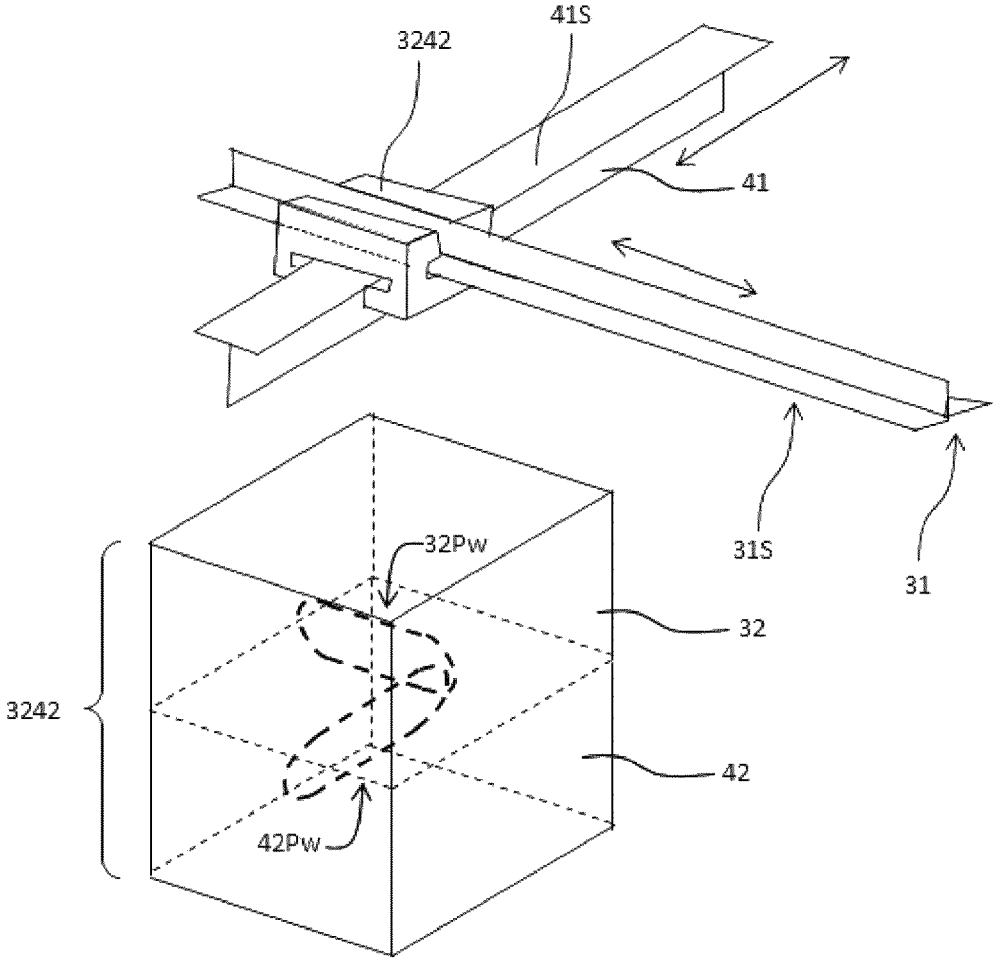
Figure 12B:
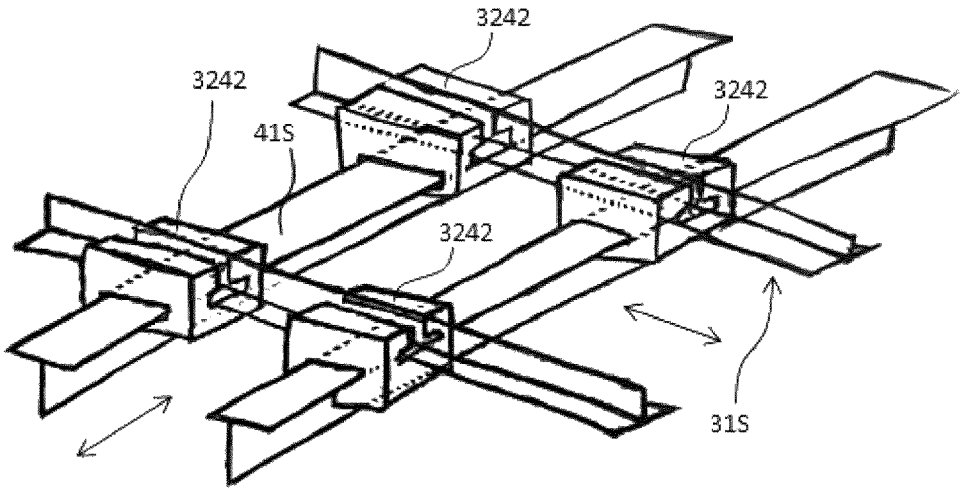

FIG. 12*a* shows, schematically, an embodiment of a construction with a first rail 31 and a second rail 41, or parallel pairs of rails 31, 41 as illustrated in FIG. 12*b*. Herein the first rail(s) 31 are perpendicular to the second rail(s) 41. Also the first rail(s) 31 cross over the second rail(s) 31. A vertical spacing is present between each second rail 41 and first rail 31 at a crossing. For example, the second rail(s) 41 is stationary mounted to the hull of a vessel, e.g. to a deck of the vessel. For example, the first rail(s) 31 forms part of a tool of the vessel, e.g. a pile holder tool.

Other than in FIGS. 1*a-c* and FIG. 2*a-b*, at the crossing of first and second rails 31, 41 first and second assemblies 32 and 42 are combined in a stacked unit 3242 that is provided in between the first and second rails 31,41.

The lower assembly 42 of the unit 3242 is configured to engage the second, lower rail 41. The upper assembly 32 of the unit 3242 is configured to engage the first, upper rail 31. Inherently, the work portion 32Pw of the first assembly 32 is directed towards the first rail 31, that is, upwards, and the work portion 42Pw of the second assembly 42 is directed to the second rail 41, that is, downwards, so that these work portions 32Pw and 42Pw engage, respectively, the bottom surface 31S of the first rail 31, and the top surface 41S of the second rail 41. Thus the work portion 32Pw and 42Pw form, respectively, a top portion and a bottom portion of the respective closed path 32P and 42P. This is shown in the schematic illustration of the unit 3242 below the construction, showing by dashed lines the closed paths 32P, 42P of the assemblies 32,42.

In the embodiment of FIG. 12*a*, the first and second rails 32,42 are both straight, extending perpendicularly to one another. When the second rail 41 is fixed to the deck 51, an object connected to the upper rail 31 may be moved in the direction of the first rail 31 since the first rail 31 is movable, and may be moved in the direction of the second rail 41 since the second rail 41 is movable—thus the unit 3242, and therewith rail 31 and the object, may be slid over the second rail 41.

In the schematic FIG. 12*b*, the same principle is applied to a construction of two parallel first rails 31 and two parallel second rails 42, wherein the same unit 3242 is provided between the rails at each crossing, so four times.

The figures, in particular FIGS. 1*a*,1*b*, 6, and 11, illustrate a method for handling an object on a vessel, comprising supporting an object 2,3, namely a pile holding tool 2,3, on the first rails 31 of the construction shown in FIGS. 1*a*,1*b*, and 1*c*, mounted to the vessel via the assemblies 32,42 of the combination. The support structure 3 of the pile holding tool 2,3 is mounted on the first assemblies 31, and support the pile holder 2, of which a ring 21 extends outboard of the vessel 5.

The method comprises moving the object 2,3, here the pile holding tool 2,3, along the one or more rails 31,41, and therewith, relative to the vessel. This moving involves for the assemblies 32,42, recirculating the endless chain of linear recirculating cylindrical rollers 32R,42R along the closed path 32P,42P defined by each assembly 32,42, the operative set of the cylindrical rollers 32R,42R engaging the rails and moving in a direction opposite to the movement of the pile holding tool 2,3.

The method further comprises:

holding a pile, here a pile 6 adapted to support a wind turbine, namely a monopile, such that it extends in a vertical orientation through the ring 21 of the pile holder 2 of the pile holding tool 2,3, wherein pile engaging devices 22 distributed about the circumference of the ring 21 engage the exterior of the pile, and lowering the pile into a body of water on which the vessel 5 is floating while being held and guided by the pile engaging devices 22.

Although vessel 5 is a jack-up vessel in FIG. 11, the method is also envisaged to be executed on a floating vessel 5. In that case, the method preferably includes motion compensation to be executed at least during the lowering of the pile 6.

The movement of the pile holding tool 2,3 may furthermore be actuated such as to include:

prior to at least the lowering of the pile 6, moving the pile holder 2,3 from a stowed position, see FIG. 1*a*, in which the a ring 21 of the pile holder 2 extends, seen in the X-Y plane of the vessel, within the contour of the vessel, to an operational position, see FIG. 1*b*, in which the ring 21 of the pile holder extends, seen in the X-Y plane of the vessel, outboard the vessel, and/or after at least the lowering of the pile and releasing the pile from the pile holder 2, including disengaging the pile engaging devices 22 from the pile, moving the pile holder 2,3 from the operational position FIG. 1*b* to the stowed position FIG. 1*a*.

Figure 13C:
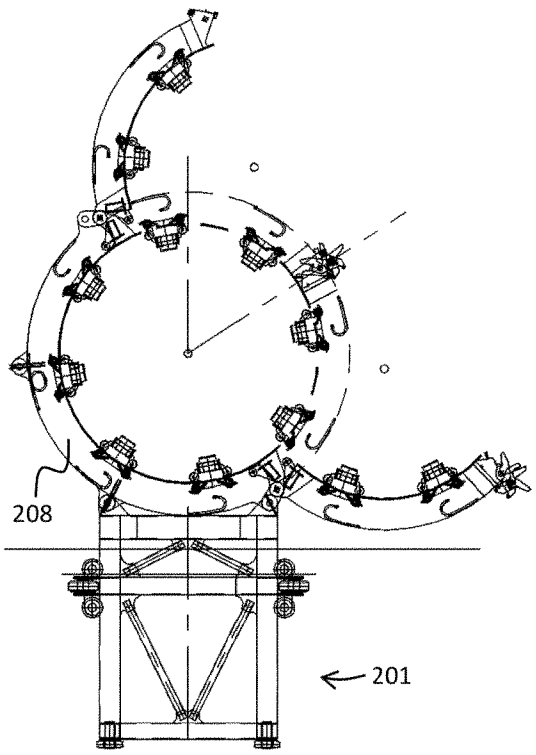
FIG. 13*c* shows in plan view, an example of a pile holder system according to the second aspect of the invention in a third distinct mounting angle position of the ring relative to the support assembly, FIG. 14 schematically shows in plan view part of a vessel with a crane and a pile holding system configured for a method according to the third aspect of the invention.
Figure 13B:
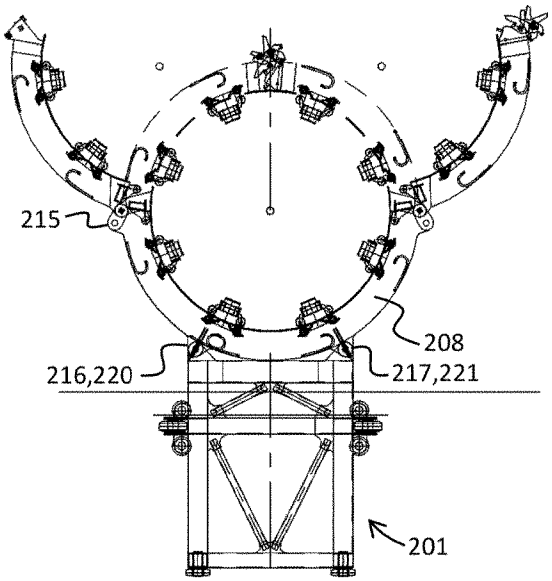
FIG. 13B shows in plan view, an example of a pile holder system according to the second aspect of the invention in a second distinct mounting angle position of the ring relative to the support assembly.
Figure 13A:
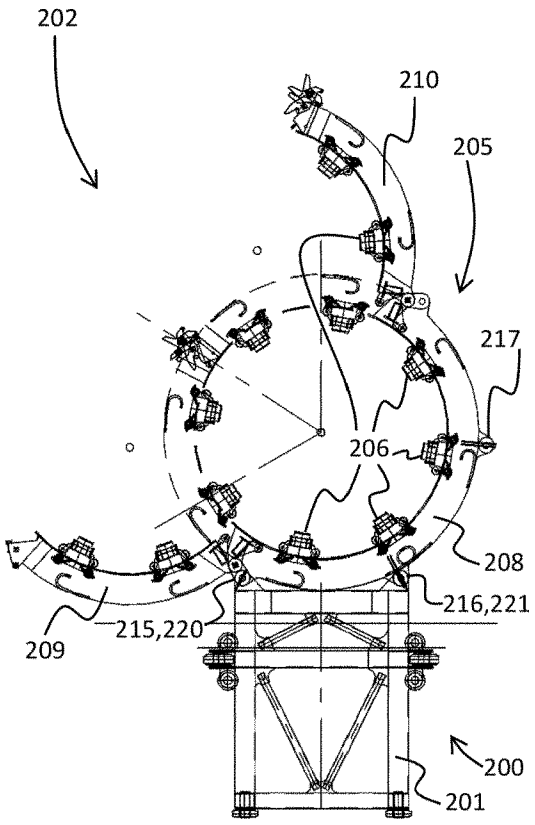
FIG. 13A shows in plan view, an example of a pile holder system according to the second aspect of the invention in a first distinct mounting angle position of the ring relative to the support assembly.

The FIGS. 13A to 13C illustrate, in plan view, the second aspect of the invention.

The pile holding system 200 is configured to be mounted on a vessel, e.g. for installation of a pile adapted to support an offshore wind turbine, e.g. a monopile, the pile holding system comprising:

a support assembly 201 configured to be mounted on the vessel, e.g. on a deck of the vessel, a pile holder 202 mounted on the support assembly 201, wherein the pile holder is configured to hold a pile (not shown) in a vertical orientation, e.g. during lowering onto the seabed and during pile driving of the pile into the seabed.

The pile holder comprises at least one ring 205, which is provided with multiple pile engaging devices 206 distributed about a circumference of the ring, each pile engaging device being adapted to engage an exterior of a pile extending through the ring, e.g. each pile engaging device comprises one or more pile guiding rollers, wherein the ring comprises a ring base 208 that is secured to the support assembly 201 and one or more pivotal jaws 209, 210, e.g. two semi-circular jaws, each jaw being pivotally mounted at an inner end thereof to the ring base and having an outer end, the one or more jaws being movable between a closed position, wherein the respective ring forms a closed annulus, and an opened position, wherein an opening is present allowing for introduction of the pile into the pile holder.

The ring base 208 and the support assembly 201 are provided with cooperating releasable securing members that are configured to provide multiple distinct mounting angle positions, see FIGS. 13A, 13B, 13C, seen in plan view, of the ring relative to the support assembly.

It is shown here that the cooperating releasable securing members comprise first securing members, e.g. eye members 215, 216, 217 integral with the ring base 208 and located at multiple distinct angle positions, e.g. at three distinct angle positions, seen in plan view, and second securing members 220,221, e.g. eye members, integral with the support assembly and located at multiple distinct angle positions, e.g. at two distinct angle positions, seen in plan view, so as to allow for three distinct mounting angle positions of the ring 205 relative to the support assembly.

In an embodiment, the cooperating releasable securing members comprise first eye members integral with the ring base, and second eye member integral with the support assembly, and wherein the cooperating releasable securing members comprise pins that are configured to be fitted through a set of aligned first and second eye members.

In an embodiment, the support assembly 201 is an X-Y motion compensation support assembly that is configured to provide compensation for motion of the vessel in a plane of the ring to maintain a predetermined X-Y location of the pile holder independent of motion of the vessel.

In an embodiment, the support assembly 201 comprises one or more first rails to be mounted on, or mounted on the vessel, e.g. on a deck of the vessel, a positioning frame movably supported on said one or more first rails in a first direction, where the positioning frame is provided with one or more second rails extending in a second direction, e.g. perpendicular to the first direction, and a support frame movably supported on said one or more second rails in said second direction, wherein the ring base of the ring of pile holder and the support frame are provided with said cooperating releasable securing members that are configured to provide multiple distinct mounting angle positions, seen in plan view, of the ring relative to the support frame.

Figure 14:
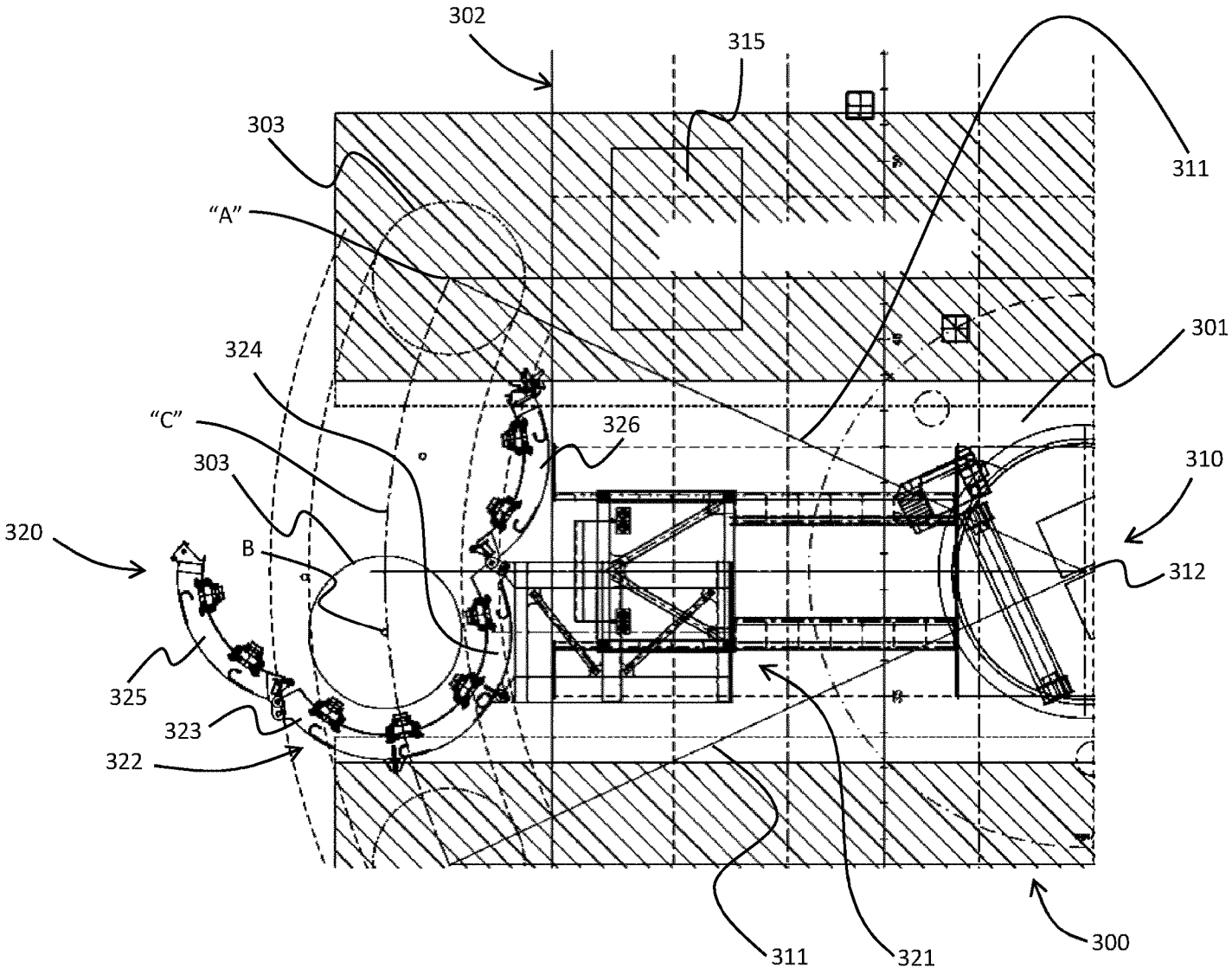
Figure 15B:
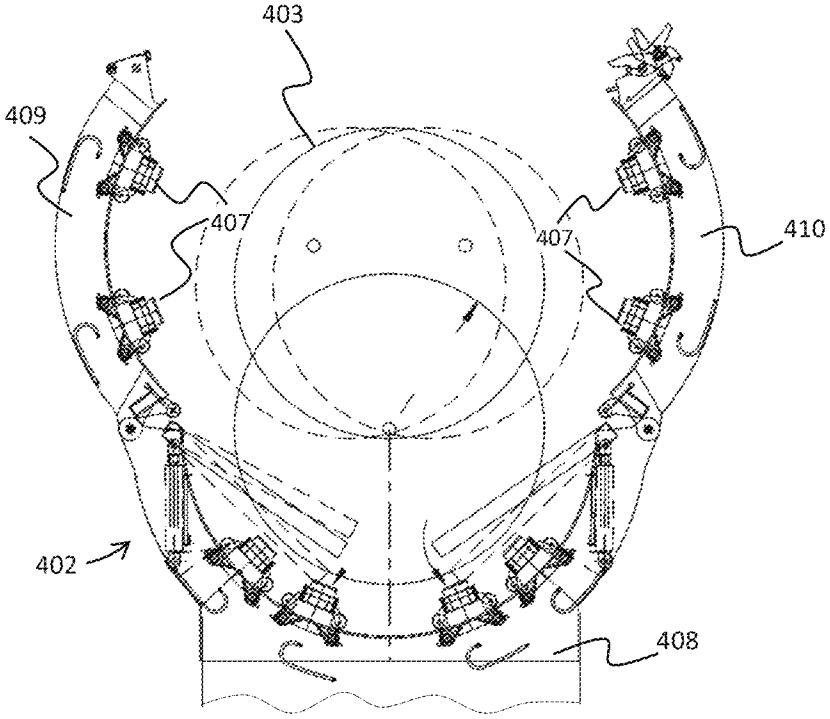
FIG. 15B illustrates the operation of the bumper devices of the pile holder system of FIG. 15A during lateral introduction of the pile.
Figure 15A:
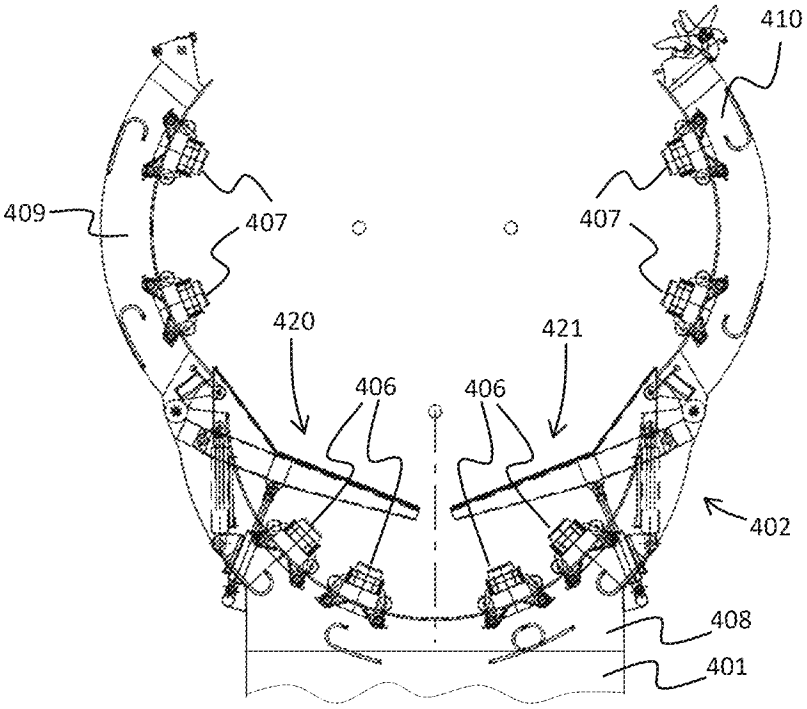
FIG. 15A shows in plan view, an example of a pile holder system having bumper devices according to the fourth aspect of the invention.
Figure 16:
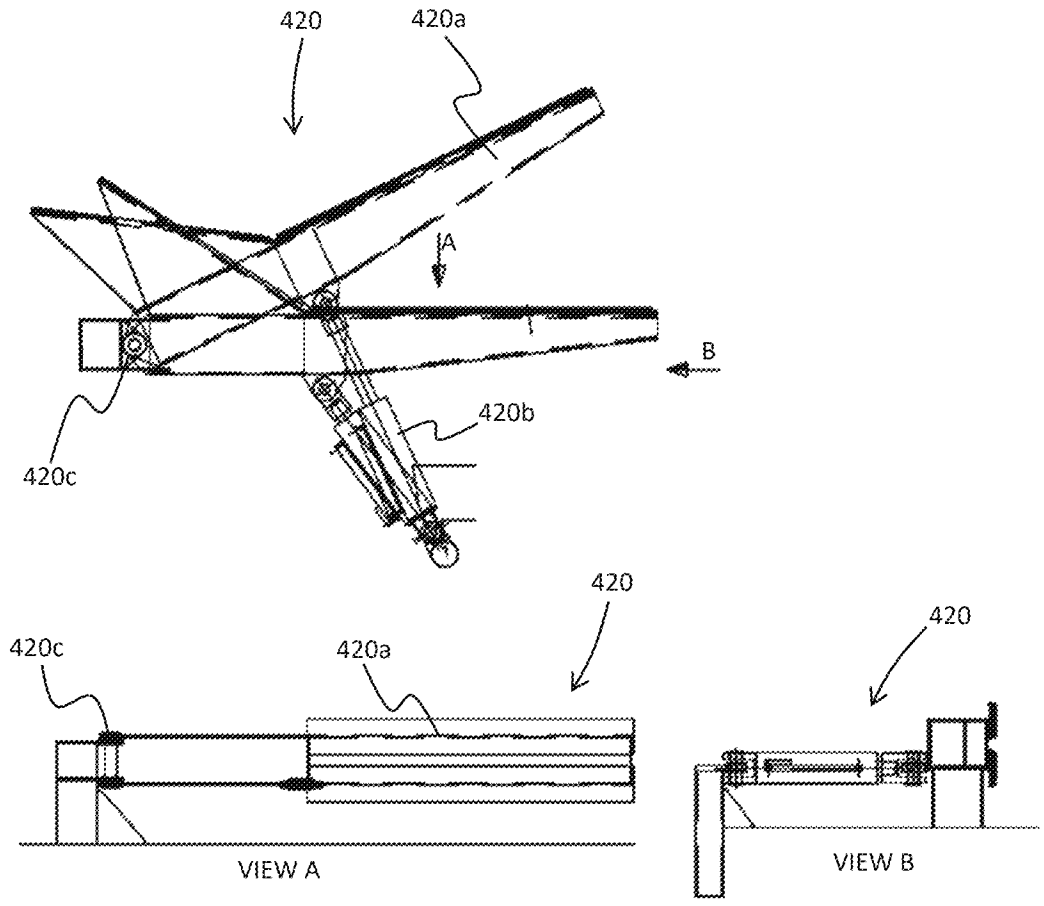
FIG. 16 illustrates in different views a bumper device of the pile holder system of FIG. 15A, and FIG. 17A,B illustrate, in plan view, the operation of the bumper device of the pile holder system of FIG. 15A.

The third aspect of the invention is illustrated in FIG. 14.

In plan view, the FIG. 14 shows a part of a hull 300 of a vessel, e.g. a jackup vessel, having a deck 301 and a side 302. It is submitted that the deck 301 of the vessel is on one side of the side 302 of the vessel, while on the opposite side of the vessel is the sea A crane 310 is erected on the deck of the vessel and has a boom 311 that is slewable by a slew drive of the crane about a vertical slew axis 312 and that is luffable about a boom axis by a luffing mechanism of the crane, which crane is configured to hoist and suspend the pile 303.

An upending tool 315 is mounted on said deck of the vessel within reach of the crane.

A pile holding system 330, distinct from said upending tool 320, is mounted on said deck of the vessel within reach of the crane, between the crane 310 and the side 302 of the vessel.

The pile holding system 330 comprises:

a support assembly 321 configured to be mounted on the vessel, e.g. on a deck of the vessel, and a pile holder 322 mounted on the support assembly, wherein the pile holder is configured to hold a pile in a vertical orientation.

The pile holder 322 comprises at least one ring 323, which is provided with multiple pile engaging devices distributed about a circumference of the ring, each pile engaging device being adapted to engage an exterior of a pile extending through the ring, e.g. each pile engaging device comprises one or more pile guiding rollers, wherein the ring comprises a ring base 324 that is secured to the support assembly and one or more pivotal jaws 325,326, e.g. two semi-circular jaws, each jaw being pivotally mounted at an inner end thereof to the ring base and having an outer end, the one or more jaws being movable between a closed position, wherein the respective ring forms a closed annulus, and an opened position, wherein an opening is present allowing for introduction of the pile into the pile holder, The pile holding system 330 enables a method according to the third aspect of the invention, wherein the method comprises:

upending of a pile 303 using the upending tool 315 to tiltable support a lower section of the pile 303 and the crane 310 to engage a lift an upper section of the pile, so that the pile is brought into vertical orientation at an upending position A relative to the hull and suspended from the crane, arranging the ring 323 of the pile holding system so that the vertically suspended pile 303 is laterally introducible into the opened annulus of the ring, closing the one or more jaws of the ring, lowering the pile onto the seabed and driving the pile into the seabed whilst the pile holder holds the pile in vertical orientation.

According to the third aspect of the invention, for said laterally introduction of the pile 303 into the opened annulus of the ring, into position B, the upending tool 315 and the ring 323 of the pile holding system are arranged such that transfer of the vertically suspended pile 303 by means of the crane 310 from the upending position into the opened annulus of the ring solely involves operation of the slew drive of the crane 310 so that the pile, seen in plan view, passes along a curved trajectory C having a radius about the slew axis 312 of the crane.

This significantly reduces complexity of said transfer, e.g. avoiding need to luff the boom during said transfer.

The FIGS. 15A to 17B illustrate a pile holding system 400 comprising:

a support assembly 401, e.g. as disclosed herein with reference to one or more of the other aspects of the invention, configured to be mounted on the vessel, e.g. on a deck of the vessel, a pile holder 402 mounted on the support assembly, wherein the pile holder is configured to hold a pile 403 in a vertical orientation, wherein the pile holder comprises at least one ring, which is provided with multiple pile engaging devices 406, 407 distributed about a circumference of the ring, each pile engaging device being adapted to engage an exterior of a pile extending through the ring during installation of the pile into the seabed, e.g. each pile engaging device comprises one or more pile guiding rollers, wherein the ring comprises a ring base 408 that is secured to the support assembly and one or more pivotal jaws 409, 410, e.g. two semi-circular jaws, each jaw being pivotally mounted at an inner end thereof to the ring base and having an outer end, the one or more jaws being movable between a closed position, wherein the respective ring forms a closed annulus, and an opened position, wherein an opening is present allowing for lateral introduction of a vertically suspended pile into the opened annulus of the ring, wherein the ring base 408 is provided, in addition to one or more of said multiple pile engaging devices 406, 407, with one or more distinct bumper devices 420, 421 that are configured to act as a bumper for the pile 403 when being introduced laterally into the opened annulus of the ring, wherein the one or more bumper devices 420, 421 are each embodied with a mobile bumper member 420*a*, 421*a* and an associated bumper actuator 420*b*, 421*b*, each bumper device being configured to move the bumper member into an operative position that is inward of the one or more pile engaging devices on the ring base so that the pile stays clear of said one or more pile engaging devices during said lateral introduction and that each bumper device being configured to move the bumper member into a non-operative position that is outward of the one or more pile engaging devices on the ring base so that the pile is positionable by means of the pile engaging devices.

Each mobile bumper member comprises a bumper beam 420*a*, 421*a* that is at one end pivotally secured to the ring base about a vertical axis 420*c*, 421*c*, the actuator 420*b*, 421*b* is configured to pivot the bumper beam relative to the ring base.

The ring base is provided with two bumper devices 420, 421, each bumper device comprising a bumper beam that is at one end pivotally secured to an end portion of the ring base about a vertical axis, so that the free ends of the bumper beams are directed towards one another seen in plan view, and the actuator is configured to pivot the bumper beam relative to the ring base. Seen in plan view, FIG. 17A shows the bumpers in an operative position, while FIG. 17B shows the bumpers in a non-operative position.

Figure 17A:
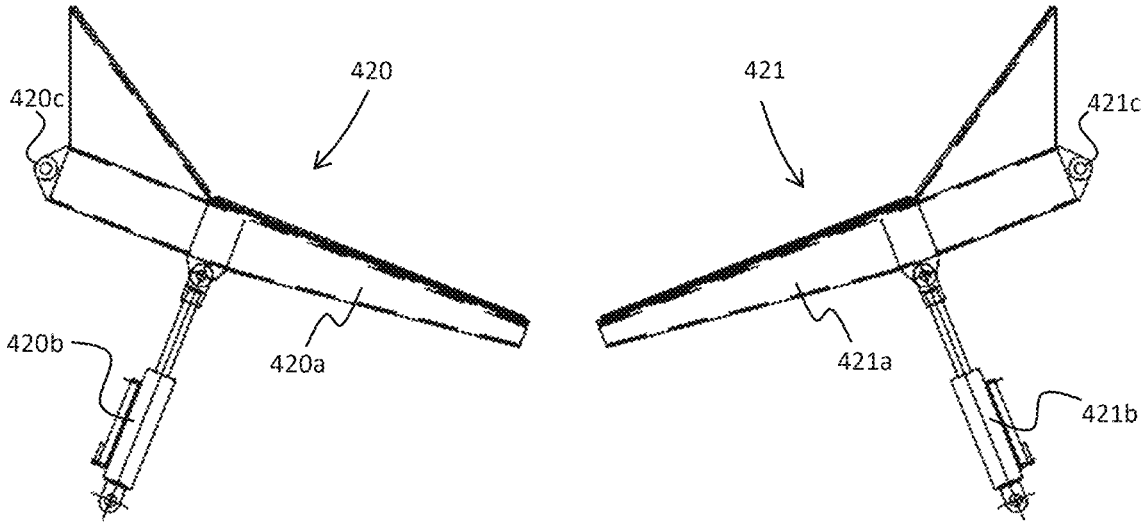
Figure 17B:
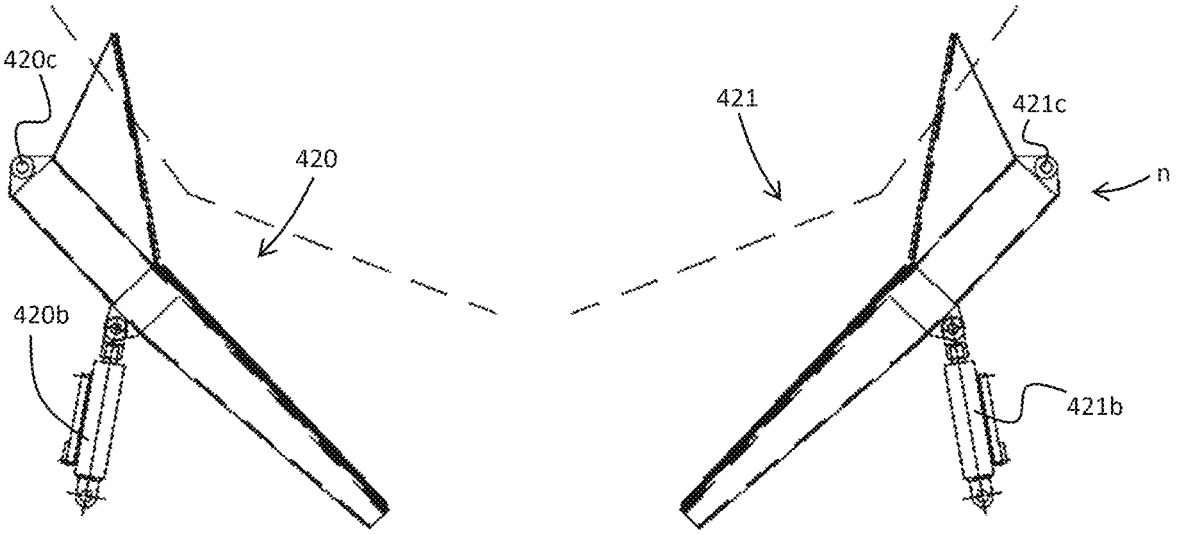

Seen in plan view, see FIGS. 17A,B, each bumper beam 420*a*, 421*a* has a front side facing the pile that comprises a first front side portion and a second front side portion that are inclined relative to one another.

The invention claimed is:

1. An assembly for supporting an object on a rail while the object moves along the rail, the assembly comprising:

a load bearing housing for carrying the object;

an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which a work portion of an operative set of the cylindrical rollers engages the rail; and a return portion defined by a return surface of the steel central body of the assembly in which a remaining set of the cylindrical rollers is free from the rail; and an elastically compressible resilient insert, the resilient insert being sandwiched between the steel central body and the steel raceway member above the work portion, so that the central body is resiliently supported on the operative set of the cylindrical rollers via the resilient insert and the steel raceway member.

2. The assembly according to claim 1, wherein the resilient insert is made of a composite material.

3. The assembly according to claim 1, wherein the raceway member and/or the resilient insert are each embodied in the form of a plate.

4. The assembly according to claim 1, wherein the raceway member and the resilient insert are both embodied in the form of a plate, and the raceway member has a smaller thickness than a thickness of the raceway member.

5. The assembly according to claim 1, wherein the central body comprises a recess inside which the resilient insert and the raceway member are contained and axially enclosed.

6. The assembly according to claim 1, wherein at a front and rear side of the load bearing surface, the return surface runs upwardly directly from the load bearing surface.

7. The assembly according to claim 1, further comprising a second endless chain of linear recirculating cylindrical rollers, arranged for recirculating along a second closed path defined by the assembly, the two paths being laterally juxtaposed and parallel to one another, the second path including a work portion that is defined by a second load bearing surface of a second raceway member and in which an operative set of the cylindrical rollers engages the rail, and a return portion that is defined by a second return surface of the central body and in which a remaining set of the cylindrical rollers is free from the rail, wherein the central body is resiliently supported on the respective operative portions of the cylindrical rollers of both endless chains via the respective raceway members, a second elastically compressible resilient insert.

8. The assembly according to claim 1, wherein the housing is provided, at least around the work portion of the recirculating cylindrical rollers, with one or more seals which together axially enclose the work portion, and an upper surface of the rail, wherein the seals, define between the load bearing surface and the upper surface of the rail a grease chamber for the operative set of the recirculating cylindrical rollers.

9. The assembly according to claim 1, wherein the housing is provided at a front and/or rear side, facing a longitudinal direction of the rail, and at a longitudinal distance from the work portion, with respectively one or more front and/or rear scrapers or brushes, engaging an upper surface of the rail for cleaning the rail.

10. The assembly according to claim 9, wherein the housing comprises:

a front and rear vertical end wall which extend laterally respectively at the front and rear side of the assembly, and a front and rear guide wall which are attached to respectively the front and rear end wall and define respectively a front and rear section of the return portion of the closed path opposite the return surface; and a front and/or rear frame which protrude respectively from the front and/or rear end wall in a frontward and/or rearward direction, and wherein the front and/or rear scraper is mounted underneath the respective frame at a longitudinal end thereof.

11. The assembly according to claim 1, wherein the housing comprises a front and rear vertical end wall which extend laterally respectively at a front and rear side of the assembly, and a front and rear guide wall which are attached to respectively the front and rear end wall and define respectively a front and rear section of the return portion of the closed path opposite the return surface.

12. The assembly according to claim 11, wherein the housing comprises a second front guide wall and a second rear guide wall, which are attached to respectively the front and rear end wall and define respectively a front and rear section of the return portion of a second closed path opposite a second return surface.

13. The assembly according to claim 1, wherein the cylindrical rollers each rotate around a respective roller axis of which head ends run over respective treads formed by vertical protrusions from the central body extending longitudinally along the closed path at respective lateral sides of the closed path.

14. A method for handling an object on a vessel, comprising:

supporting an object on one or more rails mounted to the vessel, via one or more assemblies each according to claim 1; and moving the object along the one or more rails, and therewith, relative to the vessel, the moving involving for one or more of the assemblies, recirculating the endless chain of linear recirculating cylindrical rollers along the closed path defined by each assembly, the operative set of the cylindrical rollers engaging the rails and moving in a direction opposite to the movement of the object.

15. The method according to claim 14, wherein the one or more rails comprise one or more first rails extending in a first direction, and one or more second rails extending in a second direction at an angle with the first direction, wherein the one or more assemblies comprise one or more first assemblies, and one or more second assemblies, wherein the object is supported on, and moves over, the one or more first rails via the one or more first assemblies, and the one or more first rails are supported on, and move over, the one or more second rails via the one or more second assemblies, so that the object is movable along the rails in both the first and the second direction, and wherein the one or more first rails and assemblies, and thereby the object, are moved along the one or more second rails by moving a positioning frame, via which the one or more first rails are mounted on the one or more second assemblies, along the one or more second rails.

16. The method according to claim 14, wherein the movement of the object is actuated such as to compensate for motions of the vessel in an X-Y plane of the vessel.

17. The method according to claim 14, wherein the object is a pile holding tool, and the supporting of the object comprises supporting on the one or more rails a support structure of the pile holding tool, wherein the support structure is mounted on the one or more assemblies and supports a pile holder of which a ring extends outboard of the vessel, wherein the method further comprises:

holding a pile such that the pile extends in a vertical orientation through the ring of the pile holder of the pile holding tool, wherein pile engaging devices distributed about a circumference of the ring engage an exterior of the pile; and lowering the pile into a body of water on which the vessel is floating while being held and guided by the pile engaging devices, and wherein motion compensation is executed at least during the lowering of the pile.

18. The method according to claim 17, wherein the movement of the pile holding tool is further actuated to include:

prior to at least the lowering of the pile, moving the pile holder from a stowed position, in which the ring of the pile holder extends, seen in a X-Y plane of the vessel, within a contour of the vessel, to an operational position, in which the ring of the pile holder extends, seen in the X-Y plane of the vessel, outboard the vessel; and/or after at least the lowering of the pile and releasing the pile from the pile holder, including disengaging the pile engaging devices from the pile, moving the pile holder from the operational position to the stowed position.

19. A system of one or more rails suitable or configured for being mounted to a vessel, and one or more assemblies for supporting an object on the one or more rails while the object moves along the one or more rails, wherein each assembly comprises:

a load bearing housing for carrying the object; and an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which the work portion of an operative set of the cylindrical rollers engages the rail; and a return portion defined by a return portion of the steel central body of the assembly in which a remaining set of the cylindrical rollers is free from the rail, wherein each assembly further comprises an elastically compressible resilient insert, the resilient insert being sandwiched between the steel central body and the steel raceway member above the work portion, so that the central body is resiliently supported on the operative set of the cylindrical rollers via the insert and the steel raceway member.

20. A combination of an object and the system according to claim 19, wherein the object is a tool for handling an offshore structure, wherein the combination further comprises one or more actuators for moving the tool over the one or more rails, and thus relative to the vessel, when mounted to the vessel.

21. The combination according to claim 20, wherein the tool is resiliently mounted on the one or more assemblies.

22. The combination according to claim 20, configured for holding a pile at a vessel, wherein the object is a pile holding tool comprising:

a support structure, mounted on the one or more assemblies; and a pile holder, mounted to the support structure, wherein the pile holder comprises a ring, and wherein the pile holder is configured to hold a pile in at least a vertical orientation with the ring, wherein the ring comprises multiple pile engaging devices distributed about the circumferencea circumference of the ring, each pile engaging device being adapted to engage an exterior of a pile extending through the ring.

23. A construction for supporting an object on a vessel, comprising a first and a second system of one or more rails suitable or configured for being mounted to the vessel and one or more assemblies for supporting the object on the one or more rails while the object moves along the one or more rails, wherein each assembly of each of the first and second systems comprises:

a load bearing housing for carrying the object; and an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which the work portion of an operative set of the cylindrical rollers engages the rail; and a return portion defined by a return portion of the steel central body of the assembly in which a remaining set of the cylindrical rollers is free from the rail, wherein the one or more rails of the first system are one or more first rails extending in a first direction, and the one or more assemblies are one or more first assemblies, wherein the one or more rails of the second system are one or more second rails extending in a second direction at an angle with the first direction, and the one or more assemblies are one or more second assemblies, and wherein the construction is configured to support the object on the one or more first rails via the one or more first assemblies and the one or more first rails are supported on the one or more second rails via the one or more second assemblies, so that the object is movable along the rails in both the first and the second direction.

24. A construction for supporting an object on a vessel, comprising a first and a second system, each system comprising one or more rails suitable or configured for being mounted to the vessel and comprising one or more assemblies for supporting the object on the one or more rails while the object moves along the one or more rails, wherein each assembly of each of the first and second systems comprises:

a load bearing housing for carrying the object; and an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which the work portion of an operative set of the cylindrical rollers engages the rail; and a return portion defined by a return portion of the steel central body of the assembly in which a remaining set of the cylindrical rollers is free from the rail, wherein the one or more rails of the first system are one or more first rails extending in a first direction, and the one or more assemblies are one or more first assemblies, wherein the one or more rails of the second system are one or more second rails extending in a second direction at an angle with the first direction, and the one or more assemblies are one or more second assemblies, wherein the one or more first rails cross over the one or more second rails at one or more crossings, and wherein the one or more first rails are supported on the one or more second rails at each crossing via a unit comprising a first assembly in an upper portion of the unit and a second assembly in a lower portion of the unit, the work portion of the first assembly engaging the first rail, so that the object, connected to the one or more first rails, is movable along the rails in both the first and the second direction.

25. A combination of a tool for handling an offshore structure, and a construction comprising a first system and a second system, each system comprising one or more rails suitable or configured for being mounted to a vessel, and comprising one or more assemblies for supporting an object on the one or more rails while the object moves along the one or more rails, wherein the combination further comprises one or more actuators for moving the tool over the one or more rails, and thus relative to the vessel, when mounted to the vessel, wherein each assembly of each system comprises:

a load bearing housing for carrying the object; and an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which the work portion of an operative set of the cylindrical rollers engages the rail; and a return portion defined by a return portion of the steel central body of the assembly in which a remaining set of the cylindrical rollers is free from the rail, wherein each assembly further comprises an elastically compressible resilient insert, the resilient insert being sandwiched between the steel central body and the steel raceway member above the work portion, so that the central body is resiliently supported on the operative set of the cylindrical rollers via the insert and the steel raceway member, wherein the one or more rails of the first system are one or more first rails extending in a first direction, and the one or more assemblies are one or more first assemblies, wherein the one or more rails of the second system are one or more second rails extending in a second direction at an angle with the first direction, and the one or more assemblies are one or more second assemblies, wherein the construction of the first system and the second system is configured to support the object on the one or more first rails via the one or more first assemblies and the one or more first rails are supported on the one or more second rails via the one or more second assemblies, so that the object is movable along the rails in both the first and the second direction, wherein the construction further comprises a positioning frame, via which the one or more first rails are mounted on the one or more second assemblies, so that the first system, and thereby the tool, is moveable over the one or more second rails by moving the positioning frame over the one or more second rails, wherein, for moving the tool in the second direction, the one or more actuators of the combination engage the positioning frame so as to move the positioning frame, and therewith, the first system and the tool, over the one or more second rails, and wherein, for moving the tool in the first direction, the actuators engage the tool, so as to move the tool over the one or more first rails.

26. The combination according to claim 25, wherein the combination is configured to, when the combination is mounted to the vessel, maintain a predetermined X-Y location of a pile holding tool independent of a motion of the vessel, by the actuators moving the pile holding tool over the one or more first rails and the one or more second rails, and thus relative to the vessel.

27. The combination according to claim 26, comprising an active motion compensating actuation system for moving a support structure over the rails, and thus relative to the vessel, the active motion compensating actuation system comprising the one or more actuators, wherein the actuators comprise a first actuator for moving the positioning frame over the one or more first rails, and a second actuator to move the support structure over the one or more second rails, and wherein the actuation system comprises an active wave-induced motion compensation mode in which the actuation system is operated to maintain the predetermined X-Y location of the pile holding tool independent of the motion of the vessel.

28. The combination according to claim 26, wherein a ring comprises a ring base and one or more movable jaws, each jaw being movable between a closed position, wherein the ring forms a closed annulus, and an opened position.

29. A vessel, provided with:

at least one construction of a first system and a second system, each system comprising one or more rails suitable or configured for being mounted to the vessel, and comprising one or more assemblies for supporting an object on the one or more rails while the object moves along the one or more rails, wherein each assembly of each system comprises:

a load bearing housing for carrying the object; and an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which the work portion of an operative set of the cylindrical rollers engages the rail; and a return portion defined by a return portion of the steel central body of the assembly in which a remaining set of the cylindrical rollers is free from the rail, wherein the one or more rails of the first system are one or more first rails extending in a first direction, and the one or more assemblies are one or more first assemblies, wherein the one or more rails of the second system are one or more second rails extending in a second direction at an angle with the first direction, and the one or more assemblies are one or more second assemblies, wherein the construction is configured to support the object on the one or more first rails via the one or more first assemblies and the one or more first rails are supported on the one or more second rails via the one or more second assemblies, so that the object is movable along the rails in both the first and the second direction, and wherein the one or more rails of the second system are mounted to the vessel, and wherein the one or more second rails are mounted to the vessel.

30. A vessel, provided with at least one combination of a tool for handling an offshore structure and at least one system, the system comprising one or more rails suitable or configured for being mounted to the vessel, and comprising one or more assemblies for supporting an object on the one or more rails while the object moves along the one or more rails, wherein each assembly of each system comprises:

a load bearing housing for carrying the object; and an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which the work portion of an operative set of the cylindrical rollers engages the rail; and a return portion defined by a return portion of the steel central body of the assembly in which a remaining set of the cylindrical rollers is free from the rail, wherein the combination further comprises one or more actuators for moving the tool over the one or more rails, and thus relative to the vessel, when mounted to the vessel, and wherein the one or more rails are mounted to the vessel.

31. A vessel, provided with at least one combination of an object and a construction, wherein the construction comprises a first system and a second system, each system comprising one or more rails suitable or configured for being mounted to the vessel, and comprising the one or more assemblies for supporting the object on the one or more rails while the object moves along the one or more rails, wherein each assembly comprises:

a load bearing housing for carrying the object; and an endless chain of steel cylindrical rollers arranged for recirculating along a closed path around a steel raceway member and a steel central body of the assembly, the central body being attached to or integral with the load bearing housing, the path including:

a work portion defined by a flat load bearing surface of the steel raceway member of the assembly, in which the work portion of an operative set of the cylindrical rollers engages the rail; and a return portion defined by a return portion of the steel central body of the assembly in which a remaining set of the cylindrical rollers is free from the rail, wherein the one or more rails of the first system are one or more first rails extending in a first direction, and the one or more assemblies are one or more first assemblies, wherein the one or more rails of the second system are one or more second rails extending in a second direction at an angle with the first direction, and the one or more assemblies are one or more second assemblies, wherein the construction is configured to support the object on the one or more first rails via the one or more first assemblies and the one or more first rails are supported on the one or more second rails via the one or more second assemblies, so that the object is movable along the rails in both the first and the second direction, wherein the object is a tool for handling an offshore structure, wherein the construction further comprises a positioning frame, via which the one or more first rails are mounted on the one or more second assemblies, so that the first system, and thereby the tool, is moveable over the one or more second rails by moving the positioning frame over the one or more second rails, wherein the combination further comprises one or more actuators for moving the tool over the one or more rails, and thus relative to the vessel, when mounted to the vessel, and wherein, for moving the tool in the second direction, the one or more actuators of the combination engage the positioning frame so as to move the positioning frame, and therewith, the first system and the tool, over the one or more second rails, and wherein, for moving the tool in the first direction, the actuators engage the tool, so as to move the tool over the one or more first rails.

32. The vessel according to claim 31, wherein the tool comprises:

a support structure, mounted on the one or more second assemblies; and a pile holder, mounted to the support structure, wherein the pile holder comprises a ring, and wherein the pile holder is configured to hold a pile in at least a vertical orientation with the ring, wherein the ring comprises multiple pile engaging devices distributed about a circumference of the ring, each pile engaging device being adapted to engage an exterior of a pile extending through the ring.

33. The vessel according to claim 32, wherein the ring comprises a ring base and one or more movable jaws, each jaw being movable between a closed position, wherein the ring forms a closed annulus, and an opened position.

34. The vessel according to claim 32, wherein a pile holding tool is moveable along the one or more rails between a stowed position in which the ring of the pile holder extends, seen in an X-Y plane of the vessel, within a contour of the vessel, and an operational position, in which the ring of the pile holder extends, seen in the X-Y plane of the vessel, outboard the vessel.

35. The vessel according to claim 31, wherein the combination is configured to, when the combination is mounted to the vessel, maintain a predetermined X-Y location of a pile holding tool independent of the motion of the vessel, by the actuators moving the pile holding tool over the one or more first rails and the one or more second rails, and thus relative to the vessel.

* * * * *